US005900694A

United States Patent [19]

Matsuzaki et al.

[11] Patent Number: 5,900,694

[45] Date of Patent: May 4, 1999

[54] GAS DISCHARGE DISPLAY PANEL AND MANUFACTURING METHOD THEREOF

[75] Inventors: Eiji Matsuzaki; Nobuyuki Ushifusa, both of Yokohama; Seiichi Tsuchida, Yokosuka; Teruo Takai, Isehara, all of Japan

[73] Assignee: Hitachi, Ltd., Tokyo, Japan

[21] Appl. No.: 08/778,290

[22] Filed: Jan. 2, 1997

[30] Foreign Application Priority Data

Jan. 12, 1996 [JP] Japan ..... 8-004117

[51] Int. Cl.[6] ..... H01J 1/62; H01J 63/04; H01J 17/49

[52] U.S. Cl. ..... 313/484; 313/582; 313/583; 313/584; 313/585; 313/586; 313/587

[58] Field of Search ..... 313/484, 584, 313/586, 587, 485, 486, 487, 491, 492, 585; 445/24, 25; 348/797, 798

[56] References Cited

U.S. PATENT DOCUMENTS

| | | | |
|---|---|---|---|
| 4,060,749 | 11/1977 | Shinada et al. | 313/484 |
| 4,388,550 | 6/1983 | De Vries | 313/585 |
| 4,390,808 | 6/1983 | De Vries et al. | 313/584 |
| 4,454,449 | 6/1984 | Hall | 313/584 |
| 4,638,218 | 1/1987 | Shinoda et al. | 315/169.4 |
| 4,780,644 | 10/1988 | Sakai et al. | 313/582 |
| 5,066,890 | 11/1991 | Salavin et al. | 313/585 |
| 5,313,223 | 5/1994 | Buzak et al. | 345/60 |
| 5,396,149 | 3/1995 | Kwon | 313/486 |
| 5,428,263 | 6/1995 | Nagano | 313/585 |
| 5,522,751 | 6/1996 | Taylor et al. | 445/50 |
| 5,587,624 | 12/1996 | Komaki | 313/584 |
| 5,695,378 | 12/1997 | Hecker, Jr. et al. | 445/24 |
| 5,703,437 | 12/1997 | Komaki | 313/587 |

FOREIGN PATENT DOCUMENTS

| | | | |
|---|---|---|---|
| 57-103233 | 6/1982 | Japan | 313/587 |
| 60-47340 | 3/1985 | Japan | 313/586 |
| 60-124330 | 7/1985 | Japan | 313/584 |
| 1-276531 | 11/1989 | Japan | 445/24 |
| 3-250526 | 11/1991 | Japan | 445/24 |
| 4-272634 | 9/1992 | Japan . | |
| 5-121003 | 5/1993 | Japan . | |

OTHER PUBLICATIONS

Fukshima et al. A Flat Gas–Discharge Panel TV With Good Color, Sep. 1995.

"Flat Panel Display" pp. 198–201, 1994.

*Primary Examiner*—Sandra O'Shea
*Assistant Examiner*—Mack Haynes
*Attorney, Agent, or Firm*—Antonelli, Terry, Stout & Kraus, LLP

[57] ABSTRACT

A gas discharge display panel in which opaque bus electrodes are structured in a frame shape for making each display cell clear as viewed from outside of the front substrate, and the bus electrodes function as a black matrix of the display screen. Hence the integrity of the black display status is improved and the contrast is increased.

26 Claims, 26 Drawing Sheets

GAS DISCHARGE DISPLAY PANEL AND MANUFACTURING METHOD THEREOF

BACKGROUND OF THE INVENTION

The present invention relates to a gas discharge display panel, such as a plasma display, and, more particularly, to an AC driving type gas discharge display panel having a high contrast. The invention also relates to a manufacturing method for a gas discharge display panel and to a display unit, such as a monitor, using a gas discharge display panel.

A gas discharge display panel, such as a plasma display, produces a display by its own light emission, so that the view angle is wide and the display is clearly visible. It has characteristics such that a thin panel can be produced and a large screen can be realized, and so application of a gas discharge display panel to a display unit of an information terminal device, a high-quality TV receiver, and similar display devices can be expected.

Gas discharge display panels are broadly divided into the DC driving type and the AC driving type. The AC driving type plasma display panel has a memory function by the action of a dielectric covering the electrodes and the brightness thereof is high. Recently, by application of a protective film, a life span fit for practical use has been realized and the AC driving type panel has been put to practical use as a multipurpose video monitor.

FIG. 9 shows a partial perspective view of the structure of a conventional plasma display panel. This gas discharge color display panel has a rear substrate 2 and a front substrate 1 which are arranged opposite to each other. The rear substrate 2 has a barrier rib 3*a* for maintaining the gap with the front substrate 1 constant, and the front substrate 1 and the rear substrate 2 are connected to each other via this barrier rib 3*a*. In FIG. 9, the front substrate 1 and the barrier rib 3*a* of the rear substrate 2 are separated from each other for ease of illustration of the structure.

The front substrate 1 has display electrodes (transparent electrodes) 61 and 71, bus electrodes 62 and 72, a dielectric layer 8, and an MgO film (protective film) 9 formed on a front glass plate 4. The rear substrate 2 has an address electrode 14, a barrier rib 3*a*, and a fluorescent layer 12 formed on a rear glass plate 5. The front substrate 1 and the rear substrate 2 are arranged and stuck in parallel relationships to each other so that the surfaces with electrodes face each other and a discharge space 3*f* is formed between the front substrate 1 and the rear substrate 2. The display electrodes 6 and 7 and the address electrode 14 are arranged on both sides of the discharge space 3*f* so as to cross at right angles.

Cross-sectional views of the gas discharge display panel are shown in FIGS. 10*a* to 10*c* and 22. FIG. 10*a* is a cross-sectional view of a part of the display panel of this embodiment as seen on a plane which is parallel with the address electrode 14 and perpendicular to the surfaces of the substrates 1 and 2. FIG. 10*b* is a cross-sectional view at the position 10B shown in FIG. 10*a* and the section thereof is on a plane which is perpendicular to the address electrode 14 and perpendicular to the surfaces of the substrates 1 and 2. FIG. 10*c* is a cross-sectional view at the position B shown in FIG. 10*a* and the section thereof is a plane which is perpendicular to the address electrode 14 and perpendicular to the surfaces of the substrates 1 and 2. In FIGS. 10*a* to 10*c*, only the sections are shown so as to make the drawings more easily understood, and the illustration of the constitution which will be seen behind each view is omitted. The cross-sectional view on the plane indicated by 22 shown in FIG. 10*a* is shown in FIG. 22.

As shown in FIGS. 10*b* and 10*c*, between the substrates 1 and 2, a display cell (also referred to as a discharge cell) is formed for each combination of the display electrodes 61 and 71 and the discharge space 3*f* is formed by both the substrates 1 and 2 and the barrier rib 3*a*. Inside this discharge cell, the fluorescent layer 12 is formed. The space 3*f* in the cell is charged with discharge gas. In this conventional display panel, as shown in FIG. 22, the barrier ribs 3*a* are parallel bar-shaped ribs, and the discharge spaces 3*f* of the cells which are continued transversely (or longitudinally) are not separated by the barrier ribs 3*a*. FIG. 22 is a parallel cross-sectional view of the discharge space.

When a pulse voltage is applied between the electrodes 6 and 7 of the front substrate 1 and the address electrode 14 formed on the rear substrate 2, an auxiliary discharge is generated in each cell formed by the front substrate 1, the rear substrate 2, and the barrier ribs 3*a*. On the surface of the protective layer 9 covering the parallel electrodes 6 and 7 formed in the front substrate 1 for each cell, a wall charge is formed using this auxiliary discharge. When a pulse voltage is applied between the electrodes 6 and 7 with the wall charge formed, a main discharge is generated. Ultraviolet light generated by this main discharge causes the fluorescent layer 12 coated inside each cell to emit light. The display of this display panel is realized by light from this fluorescent layer 12 which can be observed through the front substrate 1.

An example of the gas discharge display unit described above is set forth in Outsuka; Flat Panel Display 1994, pp. 198–201).

However, in the aforementioned publication, the display cells arranged in the extending direction of the address electrode 14 are separated only by the relative position of the display electrodes 6 and 7, and so, to prevent improper discharge between adjacent display cells, it is necessary to increase the distance between the display electrodes of adjacent display cells. The space between the display cells does not contribute to the display, but causes light blurring and color mixture by light emission of the existing fluorescent layer 12. The display electrodes 6 and 7 have the bus electrodes 62 and 72 for lowering the electrode resistance, and there exist many barrier ribs between the display cells arranged in the extending direction of the display electrodes. The bus electrodes are formed by an opaque material, so that they do not contribute to the display. The bad effect produced by the existence of the bus electrodes is increased when the electrodes are widened so that the electrode resistance is lowered. The existence of a portion around the display cells which does not contribute the display lowers the aperture ratio of the panel, so that a reduction in brightness is caused. Light emission between the display cells and the existence of the barrier ribs 11, which are not black, cause a reduction in the integrity of the black display status. In the display panel disclosed in the aforementioned publication, it is difficult to lower the brightness in the dark state and increase the brightness in the bright state, as mentioned above, and so a high contrast cannot be realized.

SUMMARY OF THE INVENTION

An object of the present invention is to eliminate the difficulties mentioned above and to provide a gas discharge display panel with a high contrast, as well as a manufacturing method thereof and a monitor using the display panel. In this gas discharge display panel, the resistance of the bus electrodes is low.

To accomplish the above object of the present invention, the gas discharge display panel of the present invention is structured as described below.

Generally, in a gas discharge display panel, as a main discharge electrode to be provided on the front substrate, in addition to transparent display electrodes, bus electrodes comprising an opaque conductor (metal in many cases) are provided so as to lower the resistance of the display electrodes. Therefore, to accomplish the above object, according to the present invention, the opaque bus electrodes are formed in a shape for classifying each display cell, that is, in a shape comprising a bandlike member and a branchlike member extended from the bandlike member. Furthermore, according to the present invention, it is desirable that the bus electrodes are arranged so as to surround the display cells.

Therefore, the present invention provides a gas discharge display panel comprising a front substrate having a main discharge electrode group for display, a rear substrate having an auxiliary discharge electrode group for selecting a display cell to emit light which is arranged at a fixed interval with and opposite to the front substrate, and a fluorescent layer formed on the inner wall of the space in which the main discharge takes place, wherein the main discharge electrodes have bus electrodes made of an opaque material and the bus electrodes constitute a frame surrounding the periphery of each display cell at least partially as viewed from the front substrate side along the assembly direction of the gas discharge display panel.

More specifically, it is desirable to provide a bandlike member extending in the longitudinal direction of the display electrodes and a plurality of branchlike members extending from the bandlike member in the bus electrodes, to set the bandlike member so as to separate adjacent display cell lines (display cell lines along the extending direction of the display electrodes) from each other as viewed from the front substrate side, and to set each branchlike member so as to separate adjacent display cells on each cell line from each other. By doing this, the bandlike members of the two bus electrodes are arranged along the two parallel sides among the four sides of the periphery of each display cell as viewed from the front substrate side, and the two branchlike members (four branchlike members in total) respectively extending from the bandlike members of the two adjacent bus electrodes are arranged along each of the remaining two sides, and the periphery (the gaps for preventing the branchlike members from short-circuit are excluded) of each display cell is surrounded by two bus electrodes as a whole, so that the display cells can be prevented from exhibiting a light blurring and color mixture. Namely, the bus electrodes operate as a black stripe or black matrix.

According to the present invention having the constitution shown in FIG. 25*a*, the bus electrodes 62 and 72 have branchlike members 18*b*, so that the resistance thereof is lower than that of the bus electrodes of the conventional display panel having no branchlike member. This difference will be explained by referring to FIGS. 25*a* and 25*b*. The drawing shows the shape of the bus electrode pattern schematically. FIG. 25*a* shows the electrode pattern shape of the present invention, and FIG. 25*b* shows the electrode pattern shape of the conventional display panel. In the drawing, the symbol L indicates the length of a display cell in the longitudinal direction of the display electrodes 6 and 7, L1 indicates the width of the branchlike member 18*b* of the bus electrode, W indicates the width of the display electrodes 6 and 7, and W1 a width of the bus electrodes 62 and 72 (in FIG. 25*a*, the bandlike member 18*a* of the bus electrode). In this drawing, the length of the branchlike member 18*b* of the bus electrode shown in FIG. 25*a* is W−W1. The area of one display cell is enclosed by a dashed line. The barrier ribs for separating the discharge space exist so as to overlay on the dashed line intersecting the longitudinal direction of the display electrodes 6 and 7 orthogonally. However, the barrier ribs need not always exist so as to overlay on the dashed line parallel with the longitudinal direction of the display electrodes.

When the bus electrodes are in the electrode pattern shape of the present invention, as shown in FIG. 25*a*, the resistance R1 of the bus electrodes per each display cell in the longitudinal direction of the display electrodes can be expressed by the following formula:

$$R1=Rs\times L/W1-Rs\times L1\ (1/W1-1/W)$$

where Rs indicates the sheet resistance of the electrode layers constituting the bus electrodes 62 and 72. The resistance R0 of the bus electrodes per each display cell in the longitudinal direction of the display electrodes in the conventional display panel shown in FIG. 25*b* can be expressed by the following formula:

$$R0=Rs\times L/W1$$

The comparison of the above two formulas shows that when the branchlike members 18*b* are provided in the bus electrodes, the resistance of the bus electrodes is reduced by the following value in comparison with that of the conventional example.

$$(L1/L)\times(1-W1/W)\times 100\%$$

This indicates that when the electrode width of the bus electrodes 6 and 7 is increased by the branchlike members 18*b*, the resistance is reduced. On the other hand, it also indicates that the width of the bandlike members 18*a* of the bus electrodes can be made smaller. Therefore, according to the present invention, when the occupied area of each bandlike member of the opaque bus electrodes is made smaller, the aperture ratio can be increased. As a result, the brightness of the display panel is increased and the contrast can be made higher.

In the aforementioned conventional display panel, as viewed from the front substrate 1 side, there exist many barrier ribs 3*a* between the display cells. The existence of a portion around each display cell which cannot be controlled in the display lowers the dignity of the black display status and causes a reduction in contrast as the result. Therefore, it is desirable to arrange the bandlike members and branchlike members of the bus electrodes so as to cover the barrier ribs as viewed from the front side. The reason is that by doing this, even if white ceramics are used as barrier ribs, a black display status of high dignity can be reserved and the contrast can be made higher as a result. When the bus electrodes are arranged like this, the aperture ratio of the display screen is increased, and light emitted from the phosphor which is effective in the display is efficiently radiated to the outside via the front substrate, and the brightness can be made higher. When a bandlike screening member made of an opaque material is provided in addition to the bus electrodes and the barrier ribs in the portions not covered by the bus electrodes and the portions between the display cells where the phosphor exists are covered by this screening member, the effect of the portion around each display cell, which does not contribute to the display, on the display image quality can be made smaller, so that it is more desirable.

DESCRIPTION OF THE PREFERRED EMBODIMENTS

Figure 1A:
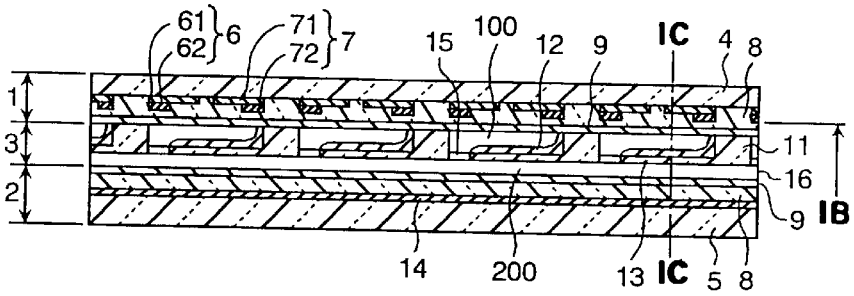
FIGS. 1*a*, 1*b*, and 1*c* are partially enlarged cross-sectional views of the gas discharge display panel of Embodiment 1.

The gas discharge display panel of the present invention comprises a front substrate having a main discharge electrode group for display, a rear substrate having an auxiliary discharge electrode group for selecting a display cell to emit light, which electrode group is arranged at a fixed interval with and opposite to the front substrate, barrier ribs (made of an insulating material) for dividing the gap between the front substrate and the rear substrate into display cells, and a fluorescent layer formed on the inner wall of the space in which the main discharge takes place. In this case, the main discharge electrode group includes a plurality of main discharge electrodes which are of equal length in the extending directions thereof, each main discharge electrode having display electrodes, which are made of a transparent material and which are bandlike electrodes disposed in parallel with the main surface of the front substrate, and bus electrodes arranged with the surface or back thereof in contact with the display electrodes, which bus electrodes are provided for each display electrode and are made of an opaque material. The bus electrodes of the auxiliary discharge electrode group each include a bandlike member extending in the longitudinal direction of the display electrodes and a plurality of branchlike members extending from the bandlike member.

It is desirable to structure the bus electrodes so as to have a black appearance as viewed from the front substrate side along the assembly direction of the gas discharge display panel. The reason is that when stray light which cannot be controlled is suppressed, the integrity of the black display status can be improved.

It is desirable to provide the bandlike member so as to separate the display cell lines along the longitudinal direction of the display electrodes from each other and to arrange the branchlike members so as to separate the display cells on the display cell lines which are adjacent to each other in the longitudinal direction of the display electrodes from each other as viewed from the front substrate side along the assembly direction of the gas discharge display panel. The reason for this is that, as described above, when the members are arranged like this, each display cell can be framed by components of the opaque bus electrodes.

As mentioned above, it is desirable to cover the barrier ribs so as to improve the integrity of the black display status. The display cells are generally arranged in the matrix state. Therefore, barrier ribs to be provided to make the display cells clear have a first member for making each display cell belonging to a display cell line along the longitudinal direction of the display electrodes clear and/or a second member for distinguishing the aforementioned display cell line from the adjacent display cell line thereof. Therefore, it is desirable to arrange the branchlike members of the bus electrodes so that at least one part thereof is seen as if overlaid on the bottom of the first member of the barrier ribs on the front substrate side as viewed from the front substrate side along the assembly direction of the gas discharge display panel, and it is desirable to arrange the bandlike member of the bus electrodes so that at least one part thereof is seen as if overlaid on the bottom of the second member of the barrier ribs on the front substrate side.

Namely, it is desirable to arrange the branchlike members so that at least one part of the aforementioned bottom of the first member of the barrier ribs is overlaid on an image which is obtained by projection on the surface on which the bus electrodes are provided from the rear substrate side along the aforementioned assembly direction and it is desirable to arrange the bandlike member so that at least one part of the aforementioned bottom of the second member of the barrier ribs is overlaid on an image which is obtained by projection on the surface on which the bus electrodes are provided from the rear substrate side along the aforementioned assembly direction.

Furthermore, it is possible to provide the aforementioned screening member so that at least one part thereof is overlaid on the bottom of the second member of the barrier ribs on the front substrate side as viewed from the front substrate side along the assembly direction of the gas discharge display panel.

According to the present invention, the bus electrodes are made of an opaque conductor, and a metal which is used generally as an electrode can be used for this purpose. As a material for the bus electrodes and auxiliary discharge electrodes, a metal such as Cu, Cr, Al Ti, Ni, W, or Mo or an alloy thereof can be used. As a method of forming these electrodes, a sputtering method, electron beam evaporation method, plating method, resistance heating evaporation method, or thick film printing method can be employed. Each bus electrode may be a multi-layer film obtained by depositing a first high melting point metal, copper or aluminum, and a second high melting point metal in this order. In this case, the first high melting point metal and the second high melting point metal are one kind of metal among chromium, titanium, nickel, tungsten, and molybdenum or an alloy of these metals, respectively. It is desirable to form an oxide film of one of the aforementioned high melting point metals on the surface of each bus electrode facing the outside the front substrate among the front and back thereof.

For the display electrodes, a transparent material having conductivity such as tin oxide or ITO is used. As a method of forming the display electrodes, a sputtering method, electron beam evaporation method, chemical vapor deposition method, or sol-gel method can be used.

According to the present invention, the main discharge electrodes are formed on the surface of a base made of a transparent insulating material. It is desirable that the surface of this base for forming main discharge electrodes is roughened. The reason is to reduce the reflectance of the surface of each bus electrode on the front side of the panel. The surface roughening process can be performed, for example, by a sandblasting method.

When a front substrate is to be prepared, if bus electrodes are formed on the surface of a base made of a transparent material first and then display electrodes are formed, a metal oxide film having a reflectance lower than that of the metal surface can be formed easily on the interface between the bus electrodes and the transparent base (glass plate, etc.). Therefore, it is desirable to set the order of deposition on the front substrate in the order of a base made of a transparent material, bus electrodes, display electrodes, and a dielectric layer.

In the aforementioned conventional display panel, an auxiliary discharge takes place in a space where the fluorescent layer 12 is provided in the same way as with the main discharge, so that the fluorescent layer 12 emits light also by auxiliary discharge. Therefore, in such a display panel, it is difficult to obtain a sufficient contrast. Accordingly, it is desirable to additionally provide a discharge space separating bulkhead wall for separating the space in the discharge cell into a main discharge space on the front substrate side and an auxiliary discharge space on the rear substrate side in the display panel of the present invention. The discharge space separating bulkhead wall has a through path for penetrating the main discharge space and the auxiliary discharge space. In this case, the fluorescent layer 12 is formed on the side of the barrier ribs and the surface of the bulkhead wall constituting the inner wall of the main discharge space. By doing this, the main discharge space and the auxiliary discharge space are separated from each other and light by auxiliary discharge is blocked off by the bulkhead wall, so that a high contrast can be obtained. It is desirable in many cases for this separating bulkhead wall to be provided, though it is not always necessary.

When the bulkhead wall is provided like this, it is desirable to arrange the bus electrodes so as to cover the opening portion of the through path of the bulkhead wall on the front substrate side as viewed from the front substrate side along the assembly direction of the gas discharge display panel. By doing this, light by auxiliary discharge coming via the through path can be blocked off, so that a high contrast can be obtained.

Next, actual embodiments of the shape and arrangement of the bus electrodes of the present invention will be explained. The term "Display cell line" refers to a line along the extending direction of the display electrodes.

Figure 1B:
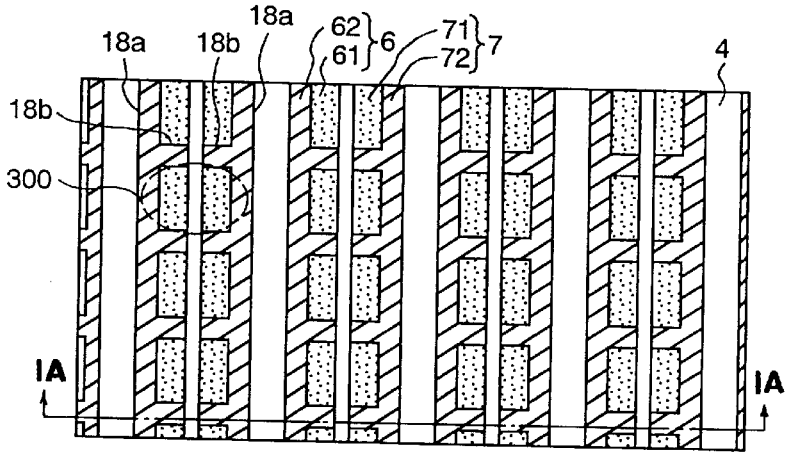
Figure 1C:
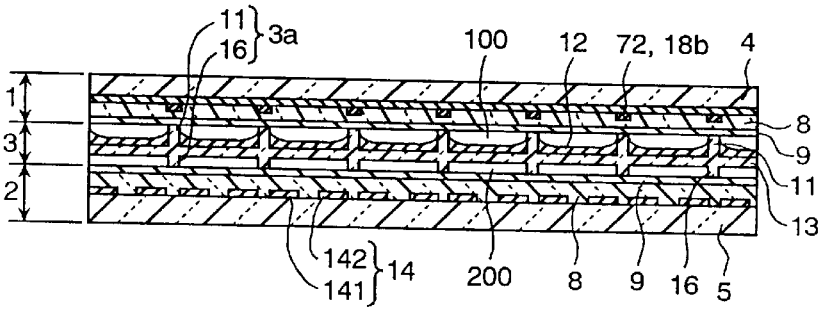

According to the example of the present invention, as shown in FIGS. 1*a* to 1*c*, two main discharge electrodes 6 and 7 are provided for each display cell line (one main discharge electrode 6 is provided for each display cell line and one main discharge electrode 7 is provided for each display cell line, so that two main discharge electrodes in total are provided for each display cell line), and the branchlike members 18*b* of the bus electrode 62 are provided on one side of the bandlike members 18*a* of the bus electrodes 62 and 72, and the bus electrodes 62 and 72 of the two main discharge electrodes corresponding to the one display cell line are arranged opposite to each other with the sides thereof on which the branchlike members 18*b* are provided facing inward. The branchlike members 18*b* are arranged so as to be overlaid on the bottom of the first member of the barrier ribs on the front substrate side as viewed from the front substrate side along the assembly direction of the gas discharge display panel.

Figure 2A:
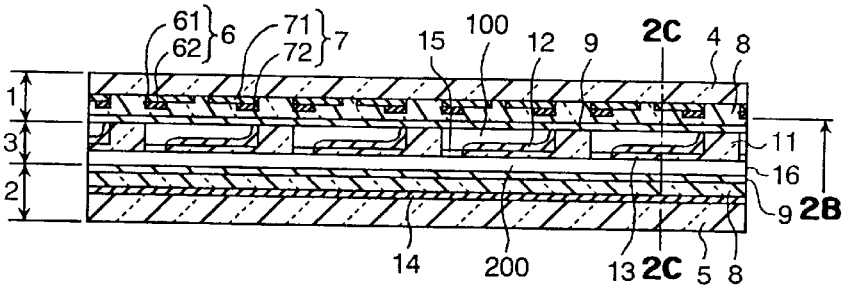
FIGS. 2*a*, 2*b*, and 2*c* are partially enlarged cross-sectional views of the gas discharge display panel of Embodiment 2.
Figure 2B:
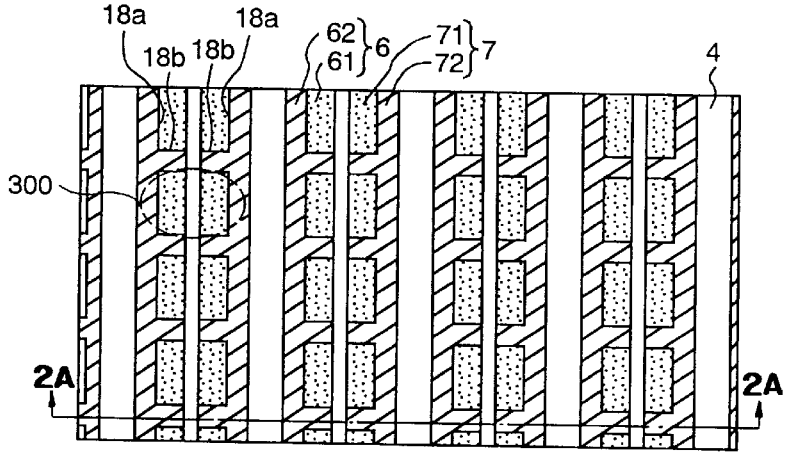
Figure 2C:
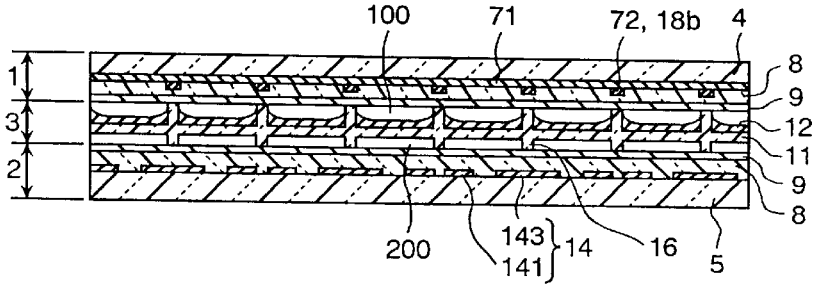

According to the example, as shown in FIGS. 2*a* to 2*c*, it is desirable to arrange the bandlike member of one (62 in FIG. 2*a*) of the bus electrodes 62 and 72 so as to overlay the opening portion of a through path (priming path) 15 of a bulkhead wall 13 on the front substrate side as viewed from the front substrate side along the assembly direction of the gas discharge display panel.

Figure 5A:
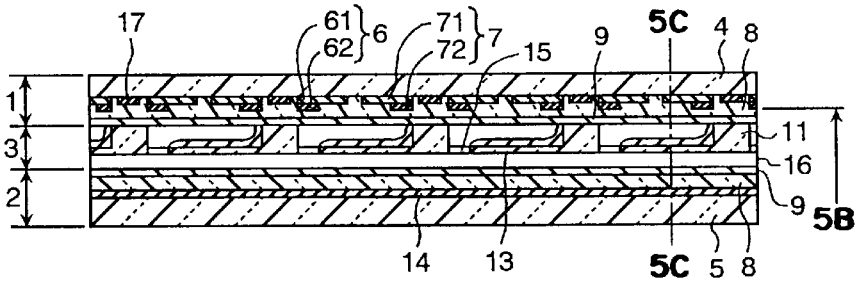
FIGS. 5*a*, 5*b*, and 5*c* are partially enlarged cross-sectional views of the gas discharge display panel of Embodiment 5.

According to another example, as shown in FIG. 5*a*, it is desirable to provide a screening member 17 made of an opaque bandlike material between the main discharge electrode 6 or 7 and the main discharge electrode 7 or 6 provided on the adjacent display cell line and to overlay the top surface of barrier ribs 11 between the display cell lines with it.

Figure 6A:
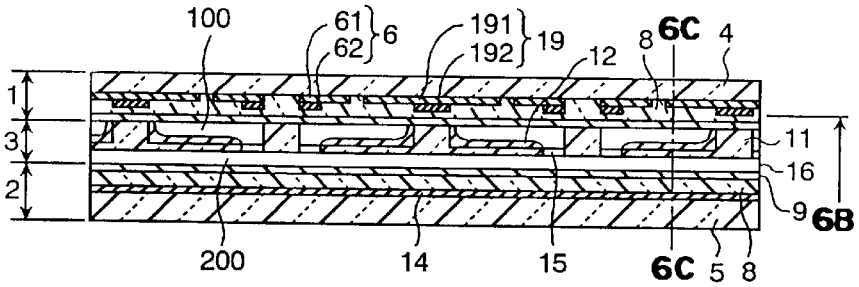
FIGS. 6*a*, 6*b*, and 6*c* are partially enlarged cross-sectional views of the gas discharge display panel of Embodiment 6.
Figure 6B:
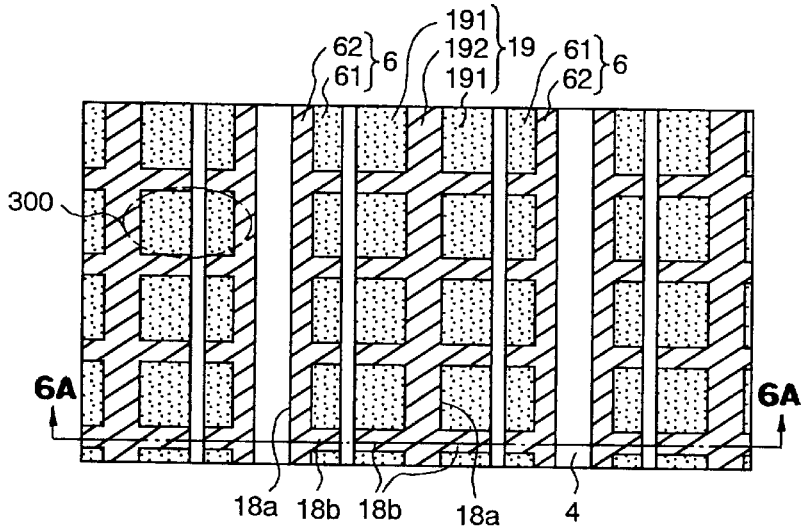
Figure 6C:
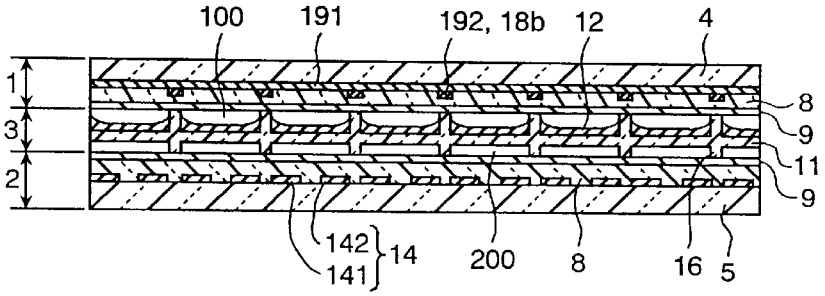

According to the example of the present invention, as shown in FIGS. 6*a* to 6*c*, three main discharge electrodes 6 and 19 are provided for each two display cell lines, and the central electrode 7 among the three main discharge electrodes 6 and 19 is provided so as to extend over the two display cell lines. According to this arrangement, it is desirable that a bus electrode 192 of the central main discharge electrode 19 among the three main discharge electrodes 6 and 19 has branchlike members 18*b* on both sides, and the bus electrodes 62 of the other main discharge electrodes 6 have branchlike members 18*b* on one side, and the aforementioned bus electrodes 62 of the other main discharge electrodes 6 are arranged so that the sides thereof on which the branchlike members 18*b* are provided face the central main discharge electrode 7. The reason is that since the panel is configured like this, the periphery of each display cell can be surrounded by the bus electrodes.

According to a further example of the present invention, the main discharge electrodes are provided for each display cell line along the extending direction of the display electrodes, and each main discharge electrode is provided so as to extend over two display cell lines. In this case, it is desirable to provide the branchlike members of each bus electrode on both sides of the bandlike member of the bus electrode.

Figure 7A:
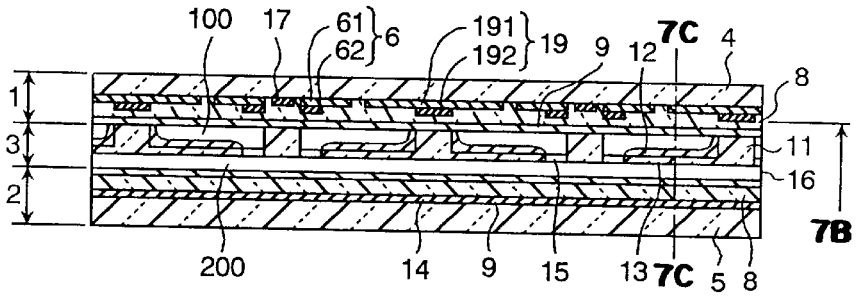
FIGS. 7*a*, 7*b*, and 7*c* are partially enlarged cross-sectional views of the gas discharge display panel of Embodiment 7.
Figure 7B:
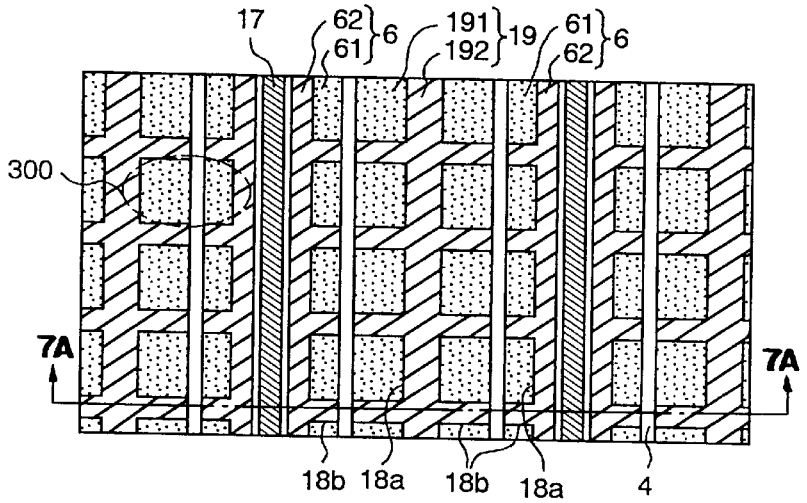
Figure 7C:
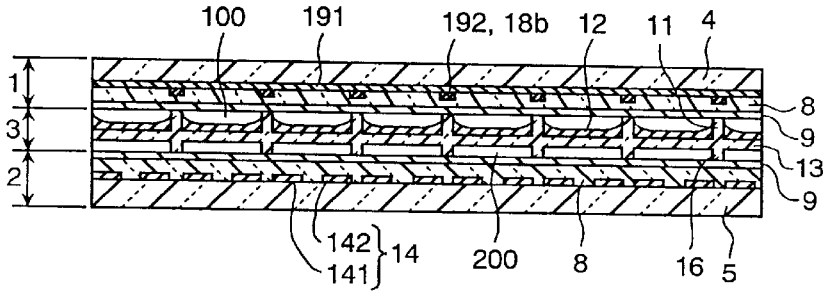

According to this further example, as shown in FIGS. 7*a* to 7*c*, it is desirable to provide the screening member 17 made of an opaque bandlike material between the two electrodes 6 on both sides among the three main discharge electrodes; 6 and 19, and the main discharge electrode 6 is provided on the adjacent display cell line and covers the top surface of the barrier ribs 11 between the display cell lines with it.

According to the examples mentioned above, it is desirable to arrange the bandlike member 18*a* of the bus electrode 192 of the main discharge common electrode 19 so as to extend over two display cell lines and to be overlaid on the bottom of the second member of the barrier ribs on the front substrate side as viewed from the front substrate side along the assembly direction of the gas discharge display panel. In the same way as with the first mentioned example, it is desirable to arrange the branchlike members 18*b* so as to be overlaid on the bottom of the first member of the barrier ribs on the front substrate side as viewed from the front substrate side along the assembly direction of the gas discharge display panel.

Figure 8A:
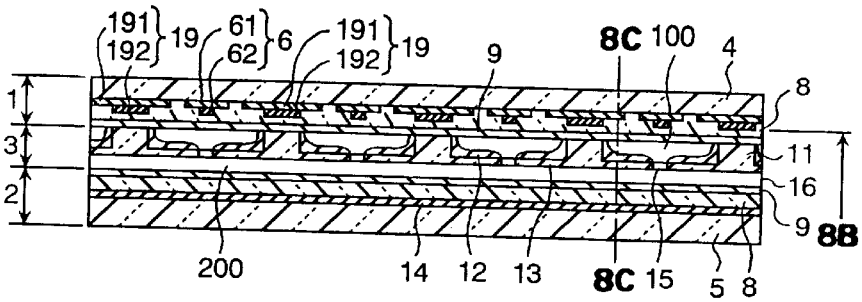
FIGS. 8*a*, 8*b*, and 8*c* are partially enlarged cross-sectional views of the gas discharge display panel of Embodiment 8.
Figure 8B:
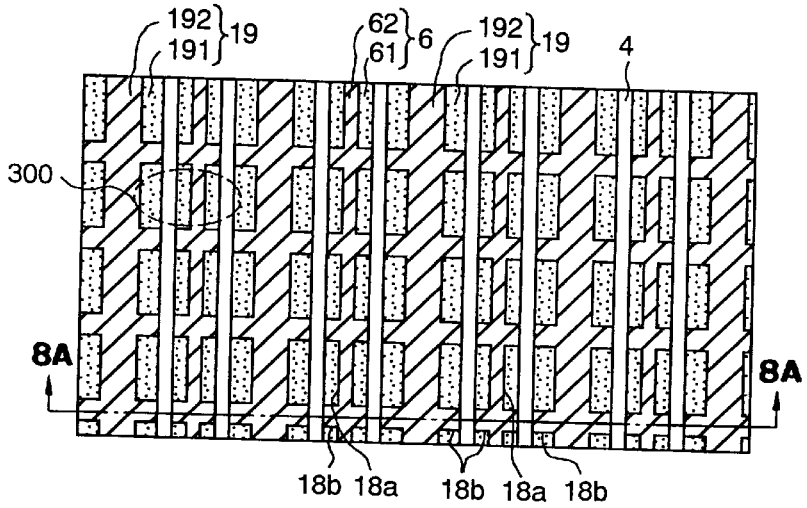
Figure 8C:
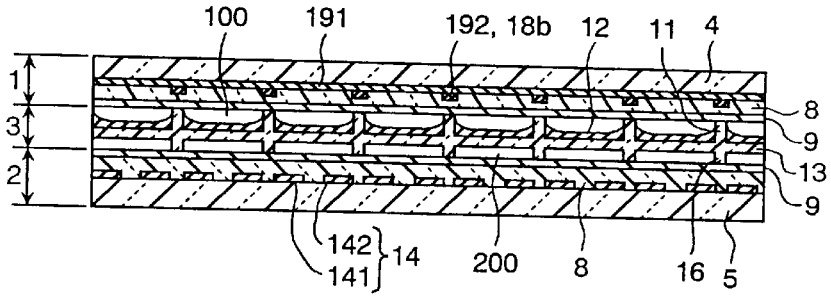
Figure 9:
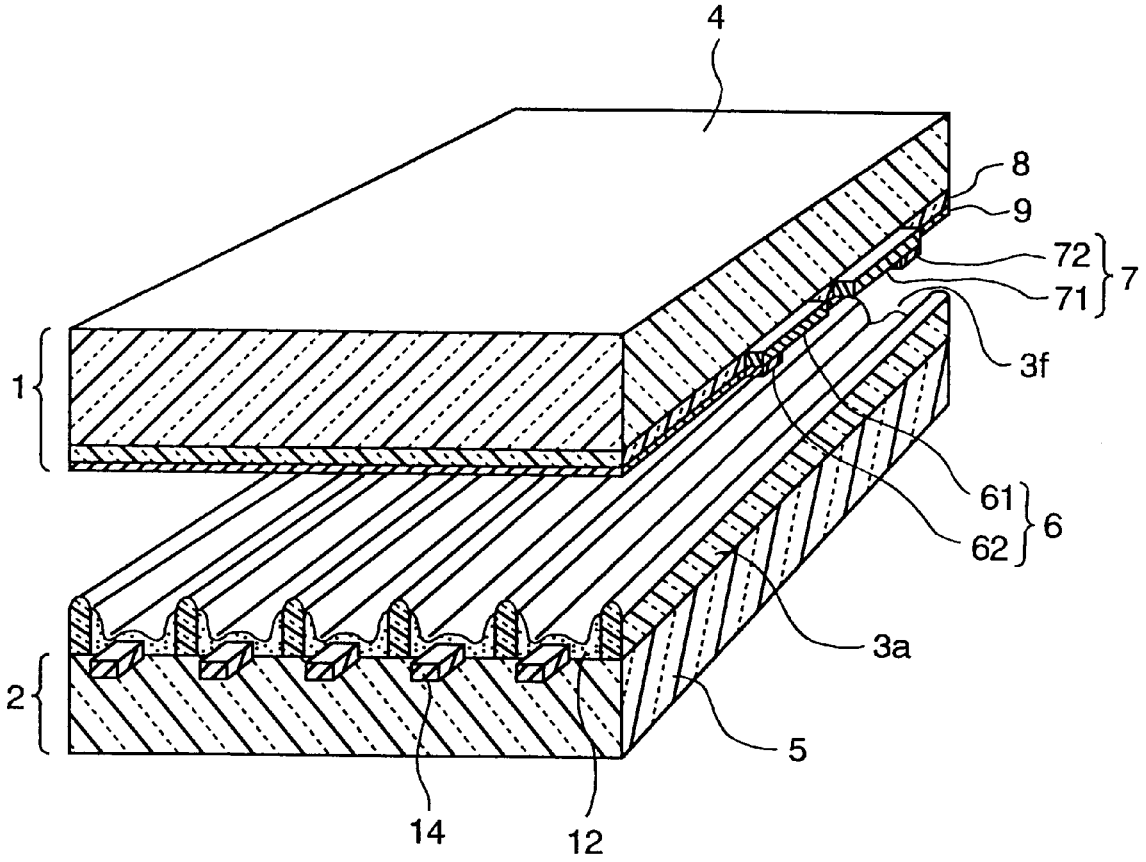
FIG. 9 PRIOR ART
FIG. 9 is a partial schematic perspective view showing a conventional example of a gas discharge display panel.

According to still another example of the present invention, as shown in FIGS. 8*a* to 8*c*, three main discharge electrodes 6 and 19 are provided for each display cell line, respectively, and the two electrodes 19 on both sides among the three main discharge electrodes 6 and 19 are common electrodes to the main discharge electrodes 19 on the adjacent display cell line. In this case, it is desirable to provide the branchlike members 18*b* of the bus electrodes 62 and 192 on both sides of the bandlike member 18*a* of the bus electrodes 62 and 192.

According to this example, when the panel is structured so as to provide the additional aforementioned discharge space separating bulkhead wall 13, it is desirable to arrange the bandlike members 18*a* of the bus electrode 192 of the main discharge common electrode 19 on both sides among the three main discharge electrodes 6 and 19 for each display cell so as to be overlaid on the bottom of the second member of the barrier ribs on the front substrate side as viewed from the front substrate side along the assembly direction, and to arrange the bandlike member 18*a* of the bus electrode 62 of the central main discharge non-common electrode 6 so as to cover the opening portion of the through path (priming path) 15 on the front substrate side. It desirable to arrange the bandlike member 18*a* of the bus electrode 192 of the common electrode 19 so as to be overlaid on the bottom of the second member of the barrier ribs on the front substrate side as viewed from the front substrate side along the assembly direction of the gas discharge display panel.

Next, the embodiments of the present invention will be explained with reference to the accompanying drawings. The term "Up" indicates the direction from the rear substrate in the assembly direction to the front substrate and the term "down" indicates the direction from the front substrate in the assembly direction to the rear substrate. The phrase "Auxiliary discharge cell line" refers to a display cell line along the extending or longitudinal direction of the auxiliary discharge electrode. The material, size, manufacturing condition, manufacturing apparatus, and other terms and conditions used in the following explanation indicate just a state of execution. Therefore, the present invention is not limited only to these conditions.

<EMBODIMENT 1>

The section of the gas discharge color display panel of this embodiment is shown in FIG. 1*a* to FIG. 1*c*. FIG. 1*a* is a cross sectional view of the display panel taken along line 1A—1A of FIG. 1*b* which is seen on a plane which is parallel with an address electrode 14 and perpendicular to the surfaces of substrates 1 and 2. FIG. 1*b* is a cross sectional view along the plane 1B shown in FIG. 1*a*and the section thereof is a plane parallel with the surface of a glass plate 4 along the extending direction of bus electrodes 62 and 72. In FIG. 1*b*, display electrodes 61 and 71 are not sections but are indicated by a pattern so as to make the drawing understandable. FIG. 1*c* is a cross sectional view at the line 1C—1C shown in FIG. 1*a*, and the section thereof is on a plane which is perpendicular to the address electrode 14 and perpendicular to the surfaces of the substrates 1 and 2.

The gas discharge color display panel of this embodiment, as shown in FIGS. 1*a* to 1*c*, has the front substrate 1, the rear substrate 2, and a bulkhead wall substrate 3 for dividing the gap between them and for forming cells which represent the pixels. In the vacant space between the front substrate 1 and the rear substrate 2, mixed gas of He and Xe (Xe content 5 volume % in this embodiment) is charged.

The front substrate 1 has a soda glass plate 4, a set of two main discharge electrodes 6 and 7 common to all the cells on the cell lines which are formed on the surface thereof and perpendicular to the plane of FIG. 1, a dielectric layer 8 formed on the surface of the soda glass plate 4 so as to cover the electrodes 6 and 7, and a protective film (MgO film) 9 is formed on the surface of the dielectric layer 8. Each main discharge electrode comprises ITO (indium tin oxide) electrodes 61 and 71 which are transparent display electrodes and bus electrodes 62 and 72 formed on the surfaces of the ITO electrodes 61 and 71.

The electrode pattern of the display electrodes 61 and 71 is a pattern of many parallel straight lines formed so that two parallel electrodes are provided for each cell on the cell lines formed in one direction among the cells arranged in the matrix state.

The bus electrodes 62 and 72 are provided for each of the display electrodes 61 and 71 and comprise bandlike members 18*a* and branchlike members 18*b* as shown in FIG. 1*b*. The branchlike members 18*b* of the bus electrode 62 are provided on one side of the bandlike members 18*a* of the bus electrodes 62 and 72 and the bus electrodes 62 and 72 of the two main discharge electrodes corresponding to the one display cell line are arranged opposite to each other with the side thereof on which the branchlike members 18*b* are provided facing inward. As shown in FIG. 1*c*, the branchlike members 18*b* are arranged so as to be overlaid on the bottom of the first member 11 of the barrier ribs on the front substrate side except for the gaps for preventing short-circuit as viewed from the front substrate side along the assembly direction of the gas discharge display panel.

As shown in FIG. 1*b*, when the shape and arrangement of the bus electrodes 62 and 72 are set as mentioned above, the periphery (the gaps for preventing the electrodes from short-circuit are excluded) of each display cell 300 is surrounded by the opaque bus electrodes 62 and 72 respectively as viewed from the front side, so that the display cells can be prevented from color bleeding and mixture.

Figure 25A:
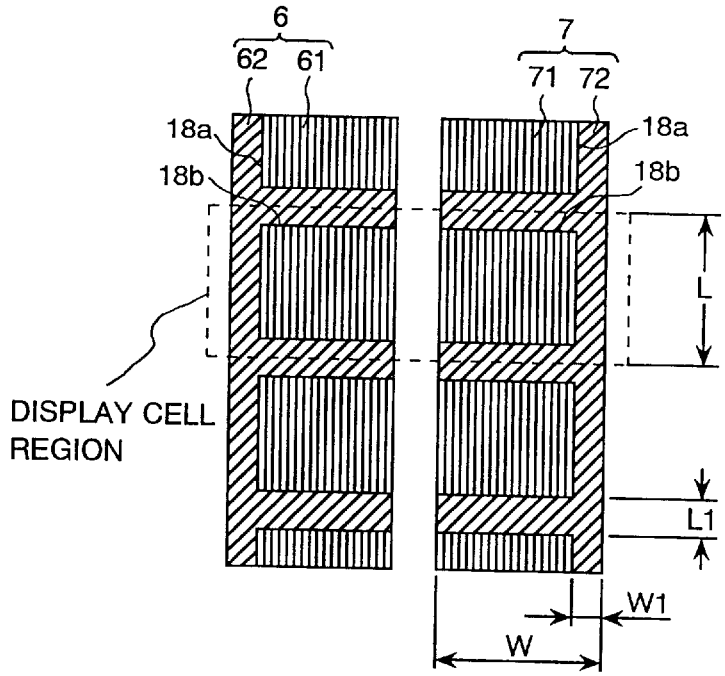
FIGS. 25*a* and 25*b* are plan views showing the shape of bus electrodes of a gas discharge display panel of an embodiment of the present invention.
Figure 25B:
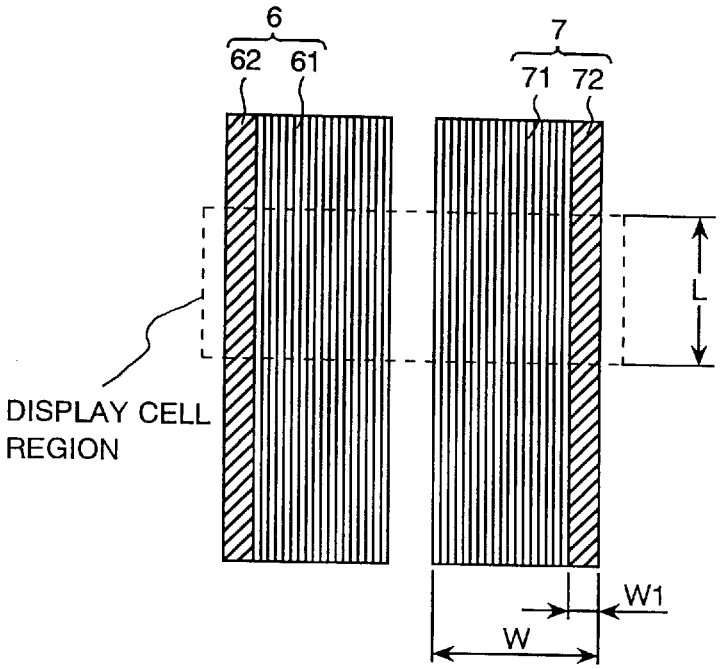
FIG. 25b (PRIOR ART)

The resistance of the bus electrodes 62 and 72 is reduced due to existence of the branchlike members 18*b*, so that the width of the bandlike members 18*a* can be made smaller than that of the conventional example having no branchlike member. An explanation thereof with reference to FIG. 25*a* and FIG. 25*b* is provided below. For example, assuming that the length (L) of the display electrodes 6 and 7 of the display cell in the extending direction is 0.4 mm, and the width (L1) of the branchlike members 18*b* of the bus electrodes is 0.1 mm, and the width (W1) of the bandlike members 18*a* of the bus electrodes 62 and 72 is 0.08 mm, and the length W–W1 of the branchlike members 18*b* is 0.42 mm, to make the resistance of the bus electrodes of the conventional example having no branchlike member as shown in FIG. 25 (*b*) equal to that of this embodiment, it is necessary to set the width of the bus electrodes to 0.1 mm or more. This effect is high when the width W1 of the bus electrodes is decreased and the aperture ratio is increased or the width of the bandlike members 18*a* of the bus electrodes is not increased, but the resistance thereof is lowered. Namely, this embodiment is effective in providing an improvement of the brightness and contrast due to improvement of the aperture ratio and high speed driving due to low resistance of the bus electrodes.

The rear substrate 2 has a soda glass plate 5, an auxiliary discharge electrode 14 formed on the surface thereof, a dielectric layer 8 formed on the surface of the auxiliary discharge electrode 14, and a protective film (MgO film) 9 formed so as to cover the surface of the dielectric layer 8. The auxiliary discharge electrode 14 comprises two bandlike address electrodes 141 and 142 for each display cell line auxiliary discharge cell line) formed at right angles to the extending direction of the display electrodes. The address electrodes 141 and 142 are parallel with the surface of the substrate and patterned as a plurality of straight lines which are parallel with each other and extended at right angles to the extending direction of the display electrodes 61 and 71.

The MgO film 9 formed on the front substrate 1 and the rear substrate 2 has a low sputtering yield and an excellent sputtering resistance, so that damage due to sputtering by discharge can be suppressed and the film functions as a protective film for the dielectric layer 8. The MgO film 9 is effective in lengthening the life span of the display panel because the sputtering by discharge is suppressed and is also effective in reduction of the discharge voltage and stabilization of discharge because the secondary electron emission yield is high. Furthermore, the MgO film 9 is transparent, so that it passes light emitted from the fluorescent layer 12 easily and hence is suited to use to a display panel.

The bulkhead wall substrate 3 has a barrier rib 3*a* connected to the MgO film 9 of the front substrate 1 and the MgO film 9 of the rear substrate 2, a bulkhead wall 13 which is connected to the barrier rib 3*a* and is parallel with the front substrate 1 and the rear substrate 2, and a fluorescent layer 12 formed on the barrier rib 3*a* and the bulkhead wall 13 on the front substrate side. The fluorescent layer 12 comprises a phosphor for emitting light in green, blue, or red colors by ultraviolet light generated by discharge. The use of a phosphor for emitting light in the requested color is selected so that the color arrangement of the whole substrate is set to a predetermined pattern for each cell.

The barrier rib 3*a* comprises a barrier rib 11 on the front substrate side and a barrier rib 16 on the rear substrate side. The barrier ribs 11 and 16 are integrated with the bulkhead wall 13 and are made of glass or ceramics. To prevent color mixture caused when light emitted in a display cell enters the adjacent display cell, it is desirable to make the barrier rib 11 and the bulkhead wall 13 opaque white or colored so as to block off light.

A cell formed by the front substrate 1, the rear substrate 2, and the bulkhead wall substrate 3 is separated from the adjacent cell by the barrier. The space in this cell is divided into a main discharge space 100 and an auxiliary discharge space 200 by the bulkhead wall 13. The bulkhead wall 13 has a through path 15, and the through path 15 functions as a priming path for penetrating the main discharge space 100 and the auxiliary discharge space 200. According to this embodiment, the bulkhead wall 13 is provided in parallel with the glass plates 4 and 5. However, the bulkhead wall 13 need not be parallel with the glass plates 4 and 5 unless it disturbs movement of charged particles.

As shown in FIG. 1*a*, the main discharge space 100 is surrounded by the barrier rib 11 and the bulkhead wall 13 and the individual discharge cells are separated respectively. On the other hand, the auxiliary discharge space 200, as shown in FIGS. 1*a* and 1*c*, is formed in a stripe shape by the barrier rib 16 parallel with the auxiliary discharge electrode 14 and the auxiliary discharge space 200 of the discharge cells arranged along the auxiliary discharge electrode 14 is not divided. Namely, the discharge cells arranged along the auxiliary discharge electrode 14 share the auxiliary discharge space in the stripe shape.

The barrier rib 11 is formed in a lattice shape, and the thickness of the display electrodes 61 and 71 in the extending direction is 0.10 mm, and the pitch in the same direction is 1.2 mm, and the thickness of the auxiliary discharge electrode 14 in the extending direction is 0.07 mm, and the pitch in the same direction is 0.4 mm. The barrier rib 16 is formed in a stripe shape extended in the extending direction of the auxiliary discharge electrode 14, and the thickness thereof is 0.07 mm, and the pitch thereof is 0.4 mm.

The bulkhead wall 13 has a thickness of 0.1 mm, is in contact with the barrier rib 3*a* along the extending direction of the display electrodes 61 and 71, and has a through path 15 at a distance of 0.1 mm from the barrier rib 3*a* along the extending direction of the auxiliary discharge electrode 14. The size of the main discharge space 100 includes a height of 0.3 mm, a depth of 0.33 mm in the extending direction of the display electrodes 61 and 71, and a depth of 1.1 mm in the extending direction of the auxiliary discharge electrode 14. The size of the auxiliary discharge space common to the auxiliary discharge cell lines includes a height of 0.11 mm and a depth of 0.33 mm in the extending direction of the display electrodes 61 and 71. The sizes of the barrier rib 11, the barrier rib 16, the main discharge space 100, and the auxiliary discharge space 200 mentioned above are typical values on a display screen having a size of 40 inches or more and it is desirable to select them properly according to the size of a display screen and the requested resolution.

According to this embodiment, the main discharge electrodes 6 and 7 having the same extending direction are provided as a pair of main discharge electrodes for each display cell line and the address electrodes 141 and 142 having the same extending direction are provided as a pair of auxiliary discharge electrodes for each auxiliary discharge cell line.

Unless the address electrodes 141 and 142 are short-circuited with the address electrodes 141 and 142 corresponding to the adjacent auxiliary discharge cell line, a part thereof may be projected from underneath the auxiliary discharge space 200 and located under the barrier rib 16. The reason is that the auxiliary discharge space 200 of each discharge cell line in the extending direction of the display ed by the barrier ribs electrodes 61 and 16 on the rear substrate side.

In the gas discharge color display panel of this embodiment, when a voltage is applied between one main electrode 6 of the pair of main discharge electrodes and one auxiliary electrode 141 of the pair of auxiliary discharge electrodes, a display cell emitting light can be selected. This will be explained hereunder.

To cause a certain display cell to emit light, a pulse voltage is applied to the pair of auxiliary discharge electrodes 141 and 142 passing under this display cell to be caused to emit light first and an auxiliary discharge is generated. The effect of this auxiliary discharge on the fluorescent layer 12 is blocked off by the bulkhead wall 13, so that the fluorescent layer 12 will not emit light at this time. In this state, a voltage is applied between the main electrode 6 passing above the display cell to be caused to emit light and the auxiliary discharge electrode 141 passing under the display cell to be caused to emit light and a pulse voltage is further applied to the pair of main discharge electrodes 6 and 7 passing above the display cell to be caused to emit light. Then, charged particles generated by discharge in the auxiliary discharge space 200 are spread in the main discharge space 100 via the priming path 15, and a wall charge pattern is formed on the surface of the protective film 9 on the front substrate side via the dielectric layer 8, and the voltage caused by the wall charge is superimposed on the voltage applied to the pair of main discharge electrodes 6 and 7, and a main discharge is generated. Namely, a main discharge is generated in the predetermined display cell to be caused to emit light.

The charged gas (Ne gas containing 5% of Xe in this embodiment) is excited by this main discharge and generates ultraviolet light and the fluorescent layer 12 emits light by this ultraviolet light. The emitted light is projected outside via the front substrate 1.

As mentioned above, when a display cell for generating an auxiliary discharge by applying a pulse voltage to the pair of auxiliary discharge electrodes 141 and 142 passing under the designated discharge cell and generating a main discharge by applying a voltage between the main electrode 6 and the auxiliary discharge electrode 141 passing above the designated discharge cell is designated, and a main discharge is generated in the predetermined display cell by applying a pulse voltage to the pair of main discharge electrodes 6 and 7 passing above the designated cell, and visible light is generated by this main discharge, and the visible light is projected outside via the front substrate 1, an image is formed on this display panel.

As mentioned above, according to this embodiment, each cell is divided by the barrier ribs 3*a* and also the space between the front substrate 1 and the rear substrate 2 is divided by the bulkhead walls 13, so that the auxiliary discharge is blocked off from the fluorescent layer 12 so as to keep the fluorescent layer 12 away from radiation generated by the auxiliary discharge. As a result, in the display panel of this embodiment, even if an auxiliary discharge is generated by the auxiliary discharge electrode 14 on the rear substrate 2 side, light emitted by this auxiliary discharge is blocked off by the bulkhead wall 13 and the fluorescent layer 12 emits light only in response to the main discharge, so that in a cell in which only an auxiliary discharge is generated and no main discharge is generated, the fluorescent layer 12 does not emit light and only light emitted by the main discharge can be observed from the front substrate 1 side. Therefore, a sufficient contrast can be obtained.

According to this embodiment, as shown in FIGS. 1*b* and 1*c*, the branchlike members 18*b* of the bus electrodes 62 and 72 are extended toward the opposite electrode on the barrier ribs 11. Namely, on the barrier ribs 11 for making the main discharge space 100 clear, the branchlike members 18*b* of the bus electrode 62 of the main electrode 6 extend toward the other main discharge electrode 7 constituting the pair of electrodes and the branchlike members 18*b* of the bus electrode 72 of the main discharge electrode 7 extend toward the main electrode 6 constituting the pair of electrodes. As shown in FIG. 1*b*, there are bus electrodes made of an opaque material between the display cells arranged in the extending direction of the electrodes 6 and 7 of the front substrate and the amount of stray light which cannot be controlled is smaller and the integrity of the black display status is higher compared with the conventional display panel.

According to this embodiment, as shown in FIG. 1*a*, the bus electrode 62 of the main electrode 6 and the opening portion of the priming path 15 on the front substrate side are positioned so as to be overlaid as viewed from above. By this constitution, light produced by auxiliary discharge is prevented from being seen from the outside through the front substrate and the contrast can be increased.

According to this embodiment, the display electrodes 61 and 71 extend in a band shape. However, the continuity from the power source is reserved by the display electrodes 62 and 72, so that there is no need to continue the display electrodes 61 and 71 along the display cell lines and it is possible to form them as independent electrodes for each discharge cell and connect the display electrodes using the bus electrodes 62 and 72, respectively.

Next, the manufacturing method of the gas discharge display panel of this embodiment will be explained with reference to FIGS. 23*a* to 23*o*, which provide an illustration showing the manufacturing method of the display panel of this embodiment schematically.

A. Preparation of the front substrate (1) Formation of main discharge electrode

Firstly, the front substrate 1 is prepared. On one of the front and back surfaces of a soda lime glass plate 4 (width of about 85 cm, depth of about 70 cm, thickness of about 2. 8 mm) washed using a neutral detergent and other materials, an ITO film (tin oxide ($SnO_2$) film or other transparent conductive films may be used) 5*c* is formed by the sputtering method (the electron beam evaporation method or other film forming methods may be used) (FIG. 23*a*).

In a dust-proof room at a room temperature of 15 to 25° C. and relative humidity of 60%, a photosensitive resin is coated on the surface of the ITO film 5*c*, and the photosensitive resin film is exposed by an extra-high voltage mercury lamp of 3 kW (output of 8 kW) via a predetermined pattern mask at an exposure of 200 to 250 mJ/cm$^2$ and spray-developed for 105 seconds using a sodium carbonate water solution of 0.7 to 1.0% under the condition of a development temperature of 25° C. and a pressure of 1.2 kg/cm$^2$, and then washed and dried, and a resist film of the predetermined pattern is formed. Next, the exposed portion of the ITO film 5*c* is etched by etchant and then the resist film is peeled off by a peeling solution. By doing this, the ITO film 5*c* is patterned and ITO electrodes 61 and 71 are formed in predetermined locations (FIGS. 23*b*). The pattern size of the display electrodes 61 and 71 may be selected according to the size of display cells to be manufactured.

Next, on the front glass substrate 4 on which the display electrodes 61 and 71 are formed, a chromium film, a copper film, and a chromium film are formed in this order by using a film forming method, such as a sputtering method or an electron beam evaporation method. By doing this, a Cr/Cu/Cr multi-layer is formed. This multi-layer is patterned by a photo-etching method in the same way as with the above mentioned process and bus electrodes 62 and 72 are formed on the surfaces of the display electrodes 61 and 71 (FIG. 23*c*). The thickness of the Cu film and the pattern size of the bus electrodes may be determined by the resistance required for the bus electrodes.

(2) Formation of the dielectric layer

Figures 23A, 23B, 23C, 23D, 23E, 23F, 23G, 23H, 23I, 23J, 23K, 23L, 23M, 23N, 23O:
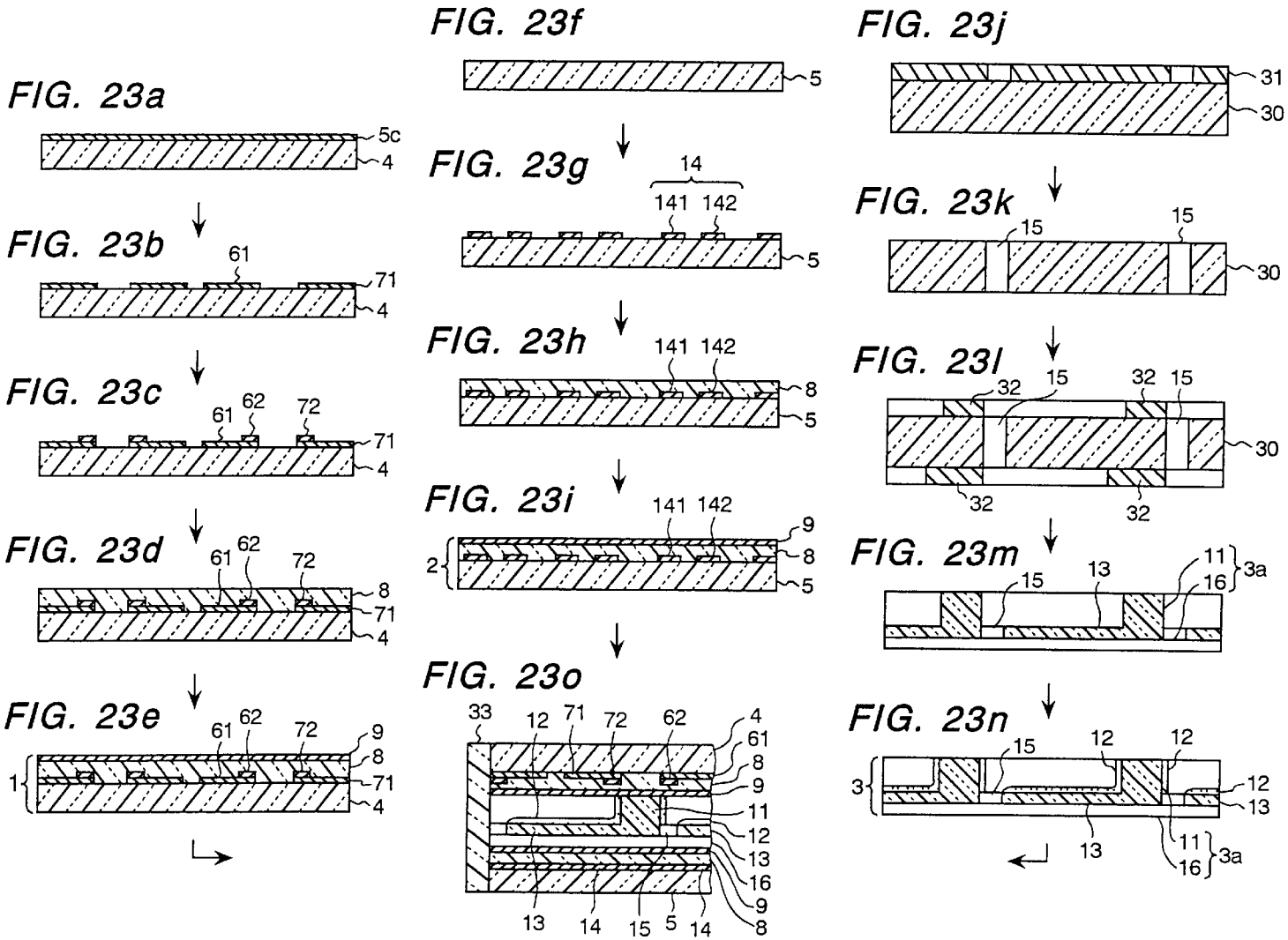
FIGS. 23*a*, 23*b*, 23*c*, 23*d*, 23*e*, 23*f*, 23*g*, 23*h*, 23*i*, 23*j*, 23*k*, 23*l*, 23*m*, 23*n*, and 23*o* are diagrams showing steps of the process; of manufacture of the gas discharge display panel of Embodiment 1.

A well-known hydrolysis is type coating material containing Al, Si, and O as main components is coated on the surface of the glass plate 4 by the blade method so as to cover the obtained electrodes 61, 62, 71, and 72 and is heated at 100 to 400° C. for minutes, and a dielectric layer 8 with a thickness of 0.005 to 0.03 mm is formed (FIG. 23*d*).

As a hydrolysis type coating material containing Al, Si, and O as main components, a gel obtained by hydrolyzing an n- butanol solution containing tri- (n- butoxy) aluminum and tetra- (n-butyl) silicate at a weight ratio of 37:63 when they are converted to an oxide at normal temperature is used.

(3) Formation of the protective film

On the surface of the obtained dielectric layer 8, an MgO film 9 with a thickness of 0.0001 to 0.005 mm is formed by the sputtering method (the electron beam evaporation method may be used) (FIG. 23*e*). By the aforementioned steps (1) to (3), the front substrate 1 is prepared.

B. Preparation of the rear substrate (4) Formation of the address electrodes

Next, the rear substrate 2 is prepared. Firstly, on a soda lime glass plate 5 (FIG. 23*f*) with a width of about 90 cm, a depth of about 65 cm, and a thickness of about 2.8 mm which is washed using a neutral detergent and other materials, a chromium film, a copper film, and a chromium film are formed by a film forming method, such as a sputtering method or an electron beam evaporation method. By doing this, a Cr/Cu/Cr multi-layer structure is formed. This multi-layer structure is patterned by a photo-etching method in the same way as with the above mentioned process and address electrodes 141 and 142 are formed (FIG. 23*g*). The thickness of the Cu film and the pattern size of the address electrodes may be determined by the resistance required for the auxiliary discharge electrode.

(5) Formation of the dielectric layer

A hydrolysis type coating material containing Al, Si, and O as main components is coated on the glass plate 5 by the blade method so as to cover the obtained address electrodes 14 in the same way as Step (2) and a dielectric layer 8 with a thickness of 0.005 to 0.03 mm is formed in the same way as Step (2) mentioned above (FIG. 23*h*).

(6) Formation of the protective film

After the dielectric layer 8 is formed by the aforementioned steps, on the surface thereof, an MgO film 9 with a thickness of 0.001 to 0.005 mm is formed in the same way as Step (3) mentioned above (FIG. 23*i*). By the aforementioned steps (4) to (6), the rear substrate 2 is prepared. In the same way as the explanation of the structure of the display panel of this embodiment, a chip tube (not shown in the drawing) for exhaust and gas introduction is attached to the rear substrate 2 after panel assembly.

C. Preparation of the bulkhead wall substrate (7) Formation of resist film Next, the bulkhead wall substrate 3 is prepared. Firstly, a ceramic plate 30 (or a boro-silicate glass plate may be used) with a width of about 85 cm, a depth of about 65 cm, and a thickness of 0.5 mm containing alumina as a main component is prepared, and a photosensitive resin is coated on one of the front and back surfaces thereof, and the photosensitive resin film is exposed by an extra-high voltage mercury lamp of 3 kW (output of 8 kW) via a mask having a predetermined pattern for preparing discharge continuity paths on the front substrate side and the rear substrate side in each cell at an exposure of 200 mJ/cm$^2$ to 250 mJ/cm$^2$. Next, the photosensitive resin film is spray- developed using a sodium carbonate water solution of 0.2% to 0.5% under the condition of a development temperature of 25° C., a pressure of 1.2 kg/cm$^2$, and a time of 105 seconds, and it is then neutralized by a dilute acid of about 0.1%, and washed and dried, and a resist film 31 of the predetermined pattern is formed (FIG. 23*j*).

(8) Formation of the continuity path

Next, a through path is made in the portion of the ceramic plate 30 which is not covered by the resist film 31 by a sandblasting method, and a discharge continuity path 15 between the space 100 on the front substrate side 1 and the space 200 on the rear substrate side 2 is formed, and the resist film 31 is peeled off by a peeling solution (FIG. 23*k*). The continuity path 15 is a through path having a bottom of 0.1 mm×0.15 mm.

(9) Formation of a resist film

A resist film 32 of a predetermined pattern is obtained on both surfaces of the ceramic plate 30 having the obtained continuity path 15 in the same way as Step (7) mentioned above (FIG. 23*l*).

(10) Formation of the barrier rib and the bulkhead wall

Next, the portion of the ceramic plate 30 which is not covered by the resist film 32 is removed by a double side sandblasting method, and the space 100 for main discharge of the cell and the space 200 for auxiliary discharge are formed, and the resist film 32 is peeled off by a peeling solution. By doing this, a component comprising a barrier rib 3*a* in which a barrier bib 11 on the front substrate side and a barrier rib 16 on the rear substrate side are integrated and a bulkhead wall 13 for separating the main discharge and auxiliary discharge is formed (FIG. 23*m*).

(11) Formation of the fluorescent layer

On this component on the front substrate side, a phosphor of green, blue, and red color is coated by the spray method (the blade method may be used) via the predetermined pattern masks for green, blue, and red colors, respectively, and the phosphor is dried at 150° C. to 300° C. for 5 minutes to 60 minutes and a fluorescent layer 12 is formed (FIG. 23*n*). When no color display is required, it is sufficient to form a fluorescent layer in the same color in each cell.

By Steps (7) to (11) mentioned above, the bulkhead wall 3, which is a component having the barrier rib 3*a*, the bulkhead wall 13, and the fluorescent layer 12 is obtained.

D. Assembly

(12) Assembly of the substrates 1 to 3

The substrates 1 to 3 obtained as mentioned above are positioned, and the peripheries thereof are coated and covered with a sealing material (frit glass) by a dispenser, and then the sealing material 33 is heat treated and fixed at 300° C. to 400° C. (FIG. 23*o*). In this case, the extending direction of the main discharge electrodes 6 and 7 provided on the front substrate 1 and the extending direction of the auxiliary discharge electrode 14 provided on the rear substrate 5 are made to intersect each other orthogonally.

(13) Charging of gas

Furthermore, the air between the front substrate 1 and the rear substrate 2 is sucked via the chip tube attached to the rear substrate 2 so as to prepare a vacuum and Ne gas containing 5% of Xe is introduced until an inner pressure of 35 to 70 kPa is obtained. Thereafter, the chip tube is heated and chipped off by local heating and the gas discharge color display panel shown in FIG. 1 is prepared.

E. Result

In the gas discharge display panel prepared by Steps (1) to (13) mentioned above, the bus electrodes 62 and 72 are shaped and arranged as shown in FIG. 1*b*, so that the bus electrodes 62 and 72 are seen as a matrix for dividing the display cell 300 vertically and horizontally as viewed from the front side, and by doing this, stray light which cannot be controlled can be prevented and the brightness in the dark state can be lowered. Light emitted by the auxiliary discharge is blocked off by the bulkhead wall 13 and only light emitted by the main discharge is observed, so that a sufficient contrast (100:1 or more) can be obtained between cells generating a main discharge and cells generating no main discharge.

According to this embodiment, a Cr/Cu/Cr multi-layer is used as a material of the bus electrodes 62 and 72 and the auxiliary discharge electrode 14. However, Ag, Cu, Cr, Al, Ti, Ni, W, or Mo or an alloy of these metals, or a multi-layer of these metals or of an alloy of these metals may be used. Furthermore, the bus electrodes 62 and 72 and the auxiliary discharge electrode 14 may be formed by a thick film printing method, vacuum evaporation method (electron beam evaporation method or resistance heating evaporation method), or plating method (electroless plating method, electroplating method). The material of the display electrodes 71 and 72 is not limited to ITO and a transparent material having sufficient conductivity, such as tin oxide, may be used. The forming method thereof is not limited to the sputtering method, but a vacuum evaporation method (electron beam evaporation method or resistance heating evaporation method), chemical vapor deposition method, or sol-gel method may be selected suitably.

The forming method for the dielectric layer is also not limited, and a sputtering method, chemical vapor deposition method, sol-gel method, or thick film printing method may be selected suitably. According to this embodiment, MgO is used as a protective layer. However, any material having a low sputtering yield for discharge gas and a high secondary electron emission yield is acceptable and CaO or Sr in addition to MgO or a mixture thereof may be used.

According to this embodiment, the sandblasting method is used to form the bulkhead wall substrate 3, but another method may be used. However, the sandblasting method and the etching method are highly precise in positioning, so that they are more suited to the present invention than a method for forming and sintering ceramics slurries. Particularly to form the barrier rib 16 on the rear substrate side, the lift- off method for forming a film pattern and then embedding a glass material or a ceramics material, and the thick film printing method are also effective forming methods.

Furthermore, according to this embodiment, a mixed gas of Ne and Xe is used as a discharge gas. However, the invention is not limited to this mixed gas. For example, a mixed gas of He and Xe which generates radiation necessary to cause a phosphor to emit light by discharge is acceptable.

According to this embodiment, the soda glass plates 4 and 5 are used as a base of the substrates 1 and 2. However, another base may be used, though it is necessary to use a transparent material as a base of the front substrate 1.

The gas discharge display unit of this embodiment can be manufactured by a low temperature process at 400° C. or lower, so that glass such as soda glass which has a low distortion point and is inexpensive can be used as a substrate. However, it is not required to keep the temperature of the manufacturing process at 400° C. or lower, but the gas discharge display unit of this embodiment can be manufactured even if the temperature of the manufacturing process is set at more than 400° C.

When a thin layer material such as Cr/Cu/Cr is used as a material of the bus electrodes 62 and 72 as shown in this embodiment, it is effective to roughen the surface of the location where the Cr/Cu/Cr pattern of the front glass substrate 4 is to be formed by the sandblasting method and lower the reflectance of Cr/Cu/Cr. The reason is that the reflectance of Cr is high. When a material having a high reflectance is used for the bus electrodes 62 and 72, the reflected light entering from the front substrate 1 side increases in intensity. Therefore, it is desirable to roughen the surfaces of the bus electrodes on the front side and make the incident light reflect irregularly so as to improve the integrity of the black display status.

<EMBODIMENT 2>

The section of the gas discharge color display panel of this embodiment is shown in FIG. 2*a* to FIG. 2*c*. FIG. 2*a* is a cross sectional view of the display panel taken along line 2A—2A of FIG. 2*b* which is seen on a plane which is parallel with an address electrode 14 and perpendicular to the surfaces of substrates 1 and 2. FIG. 2*b* is a cross sectional view in the direction 2B shown in FIG. 2*a* and the section thereof is on a plane parallel with the surface of a glass plate 4 along the extending direction of bus electrodes 62 and 72. In FIG. 2*b*, display electrodes 61 and 71 are not sections, but are indicated by a pattern so as to make the drawing more understandable. FIG. 2*c* is a cross sectional view along the line 2C—2C shown in FIG. 2*a* and the section thereof is on a plane which is perpendicular to the address electrode 14 and perpendicular to the surfaces of the substrates 1 and 2.

As shown in FIG. 2*c*, the main difference between this embodiment and Embodiment 1 is that one electrode of the auxiliary discharge electrodes 14 is used as a common electrode 143 to the adjacent display cell. In the display panel of this embodiment, two auxiliary discharge electrodes 141 for selecting a display cell address in units of two adjacent display cells and one common electrode 143 extending over auxiliary discharge cell lines are provided. Above the central portion of the auxiliary discharge common electrode 143, a barrier rib 16 is provided via the dielectric layer 8 and the protective layer 9 and separates the auxiliary discharge space 200 on the adjacent auxiliary discharge cell lines.

In this display panel, when a voltage is applied between the auxiliary discharge non-common electrode 141 and the main electrode 6, a display cell for generating a main discharge is selected.

When the auxiliary discharge electrode 14 is structured like this, the number of auxiliary discharge electrodes can be reduced extremely. This means that the auxiliary discharge space can be minimized and it is effective in the realization of a high resolution display screen. When the size of the shared auxiliary discharge electrode 143 is made smaller, the area of the non-shared auxiliary discharge electrode 141 which is overlaid on the priming path 15 can be increased and they can be positioned easily. As a result, the manufacturing process of this embodiment is stabilized more than that of Embodiment 1, and the size of the priming path 15 can be decreased, and the contrast can be made higher.

The present invention can be applied regardless of the structure of an auxiliary discharge electrode. Therefore, even in this embodiment, which is different only in the constitution of the auxiliary discharge electrode 14 from Embodiment 1, a display panel having a high resolution and a high contrast in the same way as with Embodiment 1 can be obtained.

<EMBODIMENT 3>

Figure 3A:
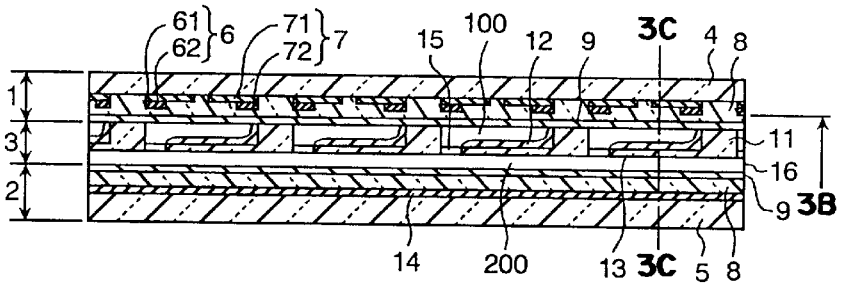
FIGS. 3*a*, 3*b*, and 3*c* are partially enlarged cross-sectional views of the gas discharge display panel of Embodiment 3.
Figure 3B:
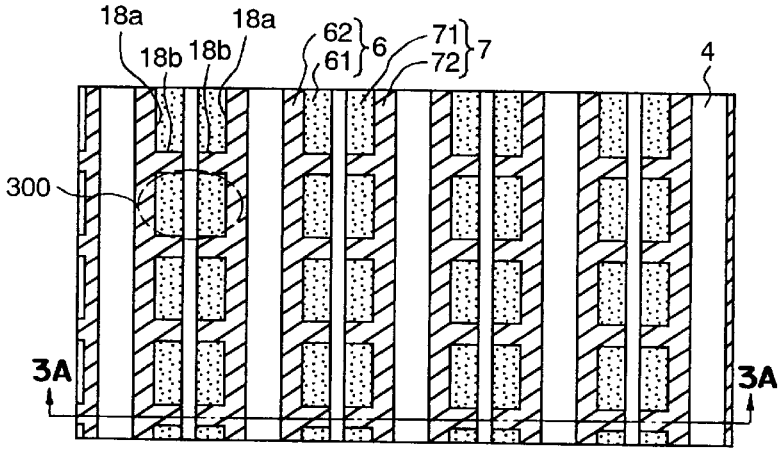
Figure 3C:
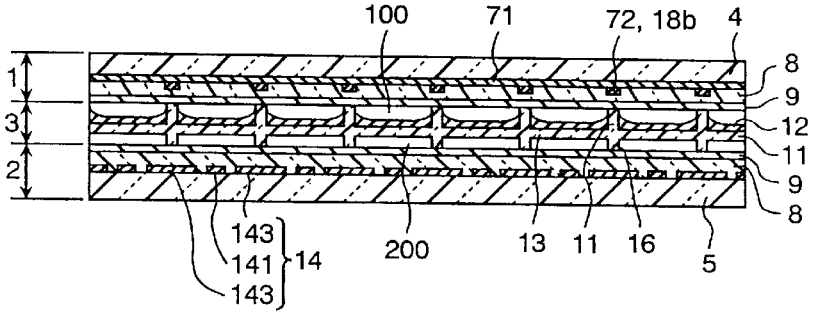

The section of the gas discharge color display panel of this embodiment is shown in FIG. 3*a* to FIG. 3*c*. FIG. 3*a* is a cross sectional view of the display panel taken along line 3A—3A of FIG. 3*b* which is seen on a plane which is parallel with an address electrode 14 and perpendicular to the surfaces of substrates 1 and 2. FIG. 3*b* is a cross sectional view in the direction 3B shown in FIG. 3*a* and the section thereof is on a plane parallel with the surface of a glass plate 4 along the extending direction of bus electrodes 62 and 72. In FIG. 3*b*, display electrodes 61 and 71 are not sections, but are indicated by a pattern so as to make the drawing more understandable. FIG. 3*c* is a cross sectional view along the line 3C—3C shown in FIG. 3*a* and the section thereof is on a plane which is perpendicular to the address electrode 14 and perpendicular to the surfaces of the substrates 1 and 2.

As shown in FIG. 3*c*, the main difference between this embodiment and Embodiment 1 is that three address electrodes 143, 141, and 143 are provided for each auxiliary discharge cell line and the two address electrodes 143 on both sides among them are used as common electrodes to the adjacent auxiliary discharge cell line. Above the central portion of each of the common electrodes 143, a barrier rib 16 is provided via the dielectric layer 8 and the protective layer 9 of MgO and separates the auxiliary discharge space 200 on the auxiliary discharge cell line lines.

In the display panel of this embodiment, an auxiliary discharge is generated between the auxiliary discharge non-common electrode 141 and the two auxiliary discharge common electrodes 143 and each display cell is selected by applying a voltage between the auxiliary discharge non-common electrode 141 and the main discharge main electrode 6.

According to this embodiment, an auxiliary discharge in each display cell is generated between two electrodes among one non-common address electrode 141 and two common address electrodes 143, so that the auxiliary discharge space is spread. Therefore, charged particles can be spread easily in the main discharge space 100 via the priming path 15. Furthermore, since an auxiliary discharge is generated between two electrodes, even if a slight dislocation occurs between the bulkhead wall substrate 3 forming the auxiliary discharge space 200 and the rear substrate 2, an auxiliary discharge corresponding to each display cell can be generated and the bulkhead wall substrate and the rear substrate can be assembled easily.

As mentioned above, the present invention can be applied regardless of the structure of the auxiliary discharge electrode. Therefore, even in this embodiment, which is different only in the constitution of the auxiliary discharge electrode 14 from Embodiment 1, a display panel having a high resolution and a high contrast in the same way as with Embodiment 1 can be obtained.

<EMBODIMENT 4>

Figure 4A:
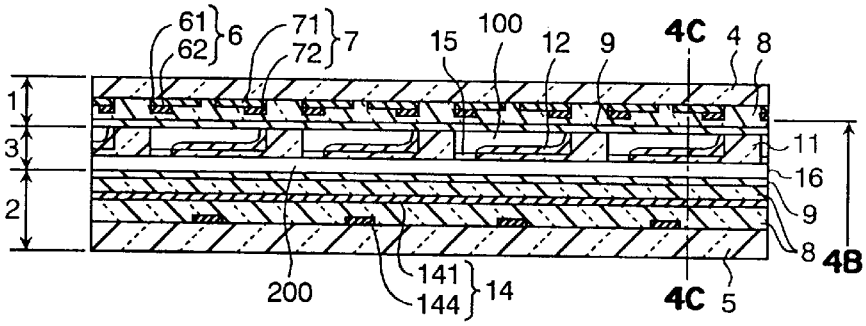
FIGS. 4*a*, 4*b*, and 4*c* are partially enlarged cross-sectional views of the gas discharge display panel of Embodiment 4.
Figure 4B:
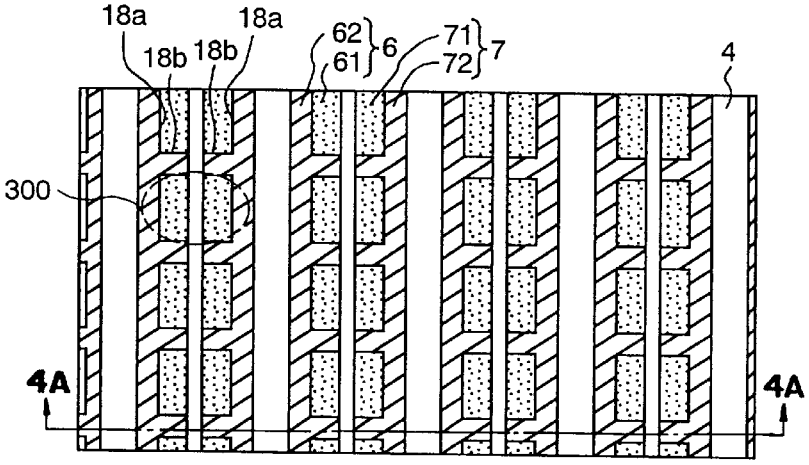
Figure 4C:
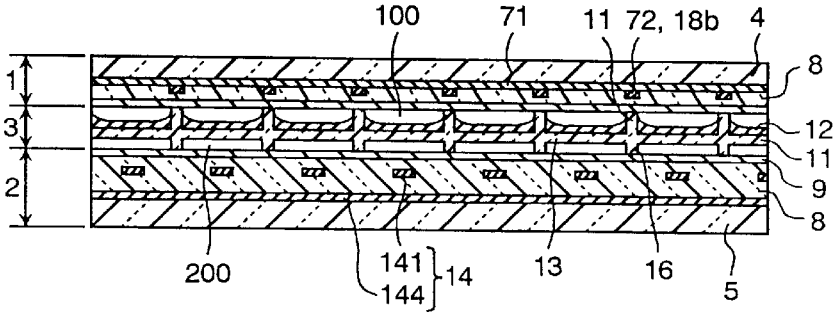

The section of the gas discharge color display panel of this embodiment is shown in FIG. 4*a* to FIG. 4*c*. FIG. 4*a* is a cross sectional view of the display panel taken along line 4A—4A of FIG. 4*b* which is viewed on a plane which is parallel with an address electrode 141 and perpendicular to the surfaces of substrates 1 and 2. FIG. 4*b* is a cross sectional view as seen in the direction 4B shown in FIG. 4*a* and the section thereof is on a plane parallel with the surface of a glass plate 4 along the extending direction of bus electrodes 62 and 72. In FIG. 4*b*, display electrodes 61 and 71 are not sections, but are indicated by a pattern so as to make the drawing more understandable. FIG. 4*c* is a cross sectional view along the line 4C—4C shown in FIG. 4*a* and the section thereof is on a plane which is perpendicular to the address electrode 141 and perpendicular to the surfaces of the substrates 1 and 2.

As shown in FIGS. 4*a* and 4*c*, the main difference between this embodiment and Embodiment 1 is the structure of the rear substrate 2. The constitution other than this and the manufacturing method are the same as those of Embodiment 1. The auxiliary discharge electrode 14 of this embodiment comprises an address electrode 141 and a trigger electrode 144 extending in a direction perpendicular to the extending direction of this address electrode 141. The address electrode 141 and the trigger electrode 144 are arranged with the dielectric layer 8 between them.

In the display cell of this embodiment, when the auxiliary discharge space 200 generating a discharge is designated by applying a voltage to the two auxiliary discharge electrodes 141 and 144, a display cell for generating a main discharge is selected. To spread charged particles caused by the auxiliary discharge in the main discharge space 100, it is possible to apply a voltage between the main electrode 6 and the address electrode 141.

Even in this embodiment, which is different only in the constitution of the auxiliary discharge electrode 14 from Embodiment 1, a display panel having a high resolution and a high contrast can be obtained by the function of the bus electrodes 62 and 72 as a black stripe.

In the display panel of each of Embodiments 1 to 3, when a voltage for moving charged particles by auxiliary discharge is applied, a display cell for generating a main discharge is selected. However, according to this embodiment, each pair of auxiliary discharge electrodes comprises the two auxiliary discharge electrodes 141 and 144 with the extending directions thereof crossing each other, so that when a pair of auxiliary discharge electrodes to which a voltage is to be applied is selected, the auxiliary discharge space 200 itself for generating an auxiliary discharge can be selected. Therefore, in the display panel of this embodiment, no auxiliary discharge is generated in a display cell generating no main discharge. Furthermore, according to this embodiment, the address electrode 141 and the trigger electrode 144 are formed on different layers, respectively, so that the existence density of the auxiliary discharge electrode 14 is lower than that of Embodiment 1. As a result, the degree of freedom for arrangement of the address electrode 141 facing the main electrode 6 is increased and the area of the address electrode 141 which is overlaid on the primary path 15 can be increased. By doing this, in this embodiment, almost all of the effect of light emitted by auxiliary the discharge on the display image quality can be eliminated. Furthermore, an effect can be obtained in which the voltage for spreading charged particles produced by auxiliary discharge in the main discharge space 100 can be lowered.

The manufacturing method of the display panel of this embodiment is the same as that of Embodiment 1 except for the manufacturing method of the rear substrate 2. Therefore, only the manufacturing method of the rear substrate 2 will be explained hereunder by referring to FIG. 24.

(i) Formation of the trigger electrode

Figure 24B:
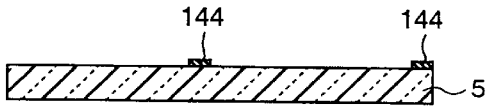
FIGS. 24*a*, 24*b*, 24*c*, 24*d*, 24*e*, 24*f*, 24*g*, and 24*h* are diagrams showing steps of the process of manufacture of the gas discharge display panel of Embodiment 4.

Firstly, on the surface of a soda glass plate 5 with a width of about 90 cm, a depth of about 65 cm, and a thickness of about 2.8 mm, which is washed with a neutral detergent and other materials, a Cr/Cu/Cr multi-layer is formed in the same away as Step (1) mentioned above, and this multi-layer is patterned by the photo- etching method in the same as Step (1), and trigger electrodes 144 with a width of 0.1 mm and a thickness of 0.002 mm are formed (FIG. 24*b*). The thickness of the trigger electrodes 144 and the pattern size may be determined according to the required resistance.

(ii) Formation of the dielectric layer

Figure 24C:
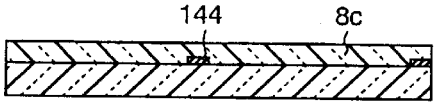
Figure 24D:
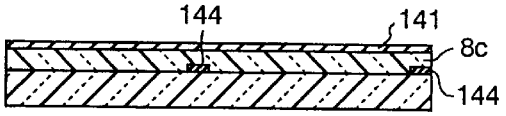

A part 8*c* of the dielectric layer 8 (thickness: 0.005 to 0.03 mm) is formed on the glass plate 5 so as to cover the obtained trigger electrodes 144 in the same way as Step (2) (FIG. 24*c*).

(iii) Formation of the address electrode and dielectric layer

Figure 24E:
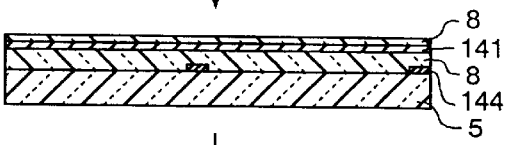
Figure 24F:
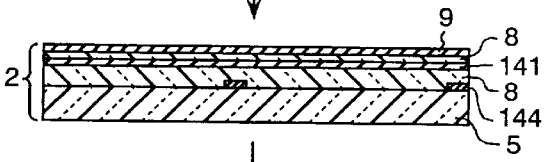
Figure 24H:
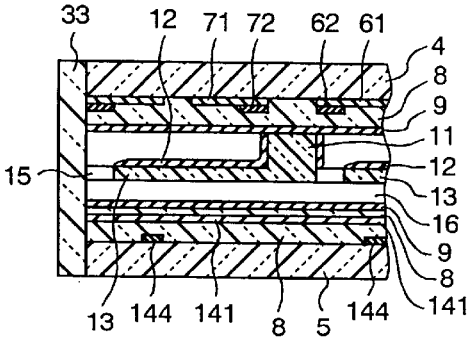
Figure 24A:
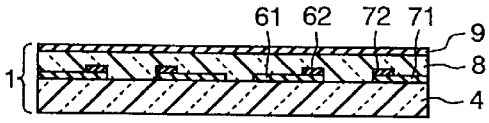
Figure 24G:
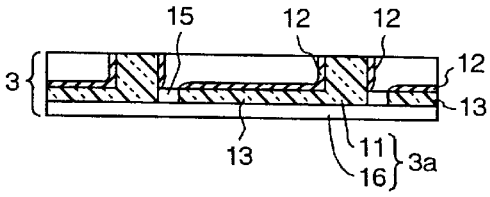

Furthermore, on the surface of the obtained one part 8*c* of the dielectric layer, an address electrode 141 comprising a Cr/Cu/Cr multi-layer is formed by the same method as that of Step (i) mentioned above (FIG. 24*d*) and the remaining part (thickness: 0.005 to 0.03 mm) of the dielectric layer 8 on the rear substrate side is formed on the dielectric layer 8*c* so as to cover the obtained address electrodes 141 in the same way as Step (ii) (FIG. 24*e*).

(iv) Formation of the protective film

Since the dielectric layer 8 is formed by the aforementioned steps, on the surface thereof, an MgO film 9 with a thickness of 0.001 to 0.005 mm is formed in the same way as Step (3). A chip tube (not shown in the drawing) for exhaust and gas introduction to be executed after panel assembly is attached to the rear substrate 2.

The rear substrate 2 obtained as mentioned above and the front substrate 1 (FIG. 24*a*) and the bulkhead wall substrate 3 (FIG. 24*g*) which are prepared in the same way as with Embodiment 1 are assembled in the same way as with that embodiment (FIG. 24*h*), and gas is charged, and the display panel of this embodiment is obtained.

According to this embodiment, a Cr/Cu/Cr multi-layer is used as a material of the trigger electrodes 144. However, Cr, Cu, Al, Ti, Ni, W, or Mo, or an alloy of these metals, or a multi-layer of these metals can be selected suitably in the same way as with the address electrode 141. Also as a forming method of the trigger electrodes 144, the electron beam evaporation method, plating method, resistance heating evaporation method, or printing method can be used suitably in the same way as with the address electrode 144.

<EMBODIMENT 5>

Figure 5B:
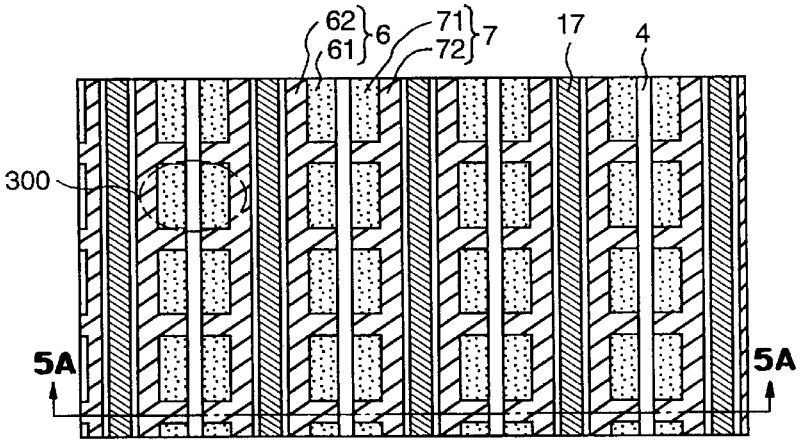
Figure 5C:
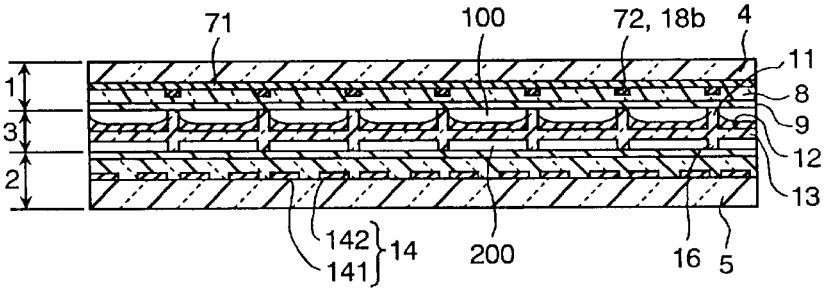

The section of the gas discharge color display panel of this embodiment is shown in FIGS. 5*a*–5*c*. FIG. 5*a* is a cross sectional view of the display panel taken along line 5A—5A of FIG. 5*b* as seen on a plane which is parallel with an address electrode 14 and perpendicular to the surfaces of substrates 1 and 2. FIG. 5*b* is a cross sectional view in the direction 5B shown in FIG. 5*a* and the section thereof is on a plane parallel with the surface of a glass plate 4 along the extending direction of bus electrodes 62 and 72. In FIG. 5*b*, display electrodes 61 and 71 and a screening member 17 are not sections, but are indicated by a pattern so as to make the drawing more understandable. FIG. 5*c* is a cross sectional view along the line 5C—5C shown in FIG. 5*a* and the section thereof is on a plane which is perpendicular to the address electrode 14 and perpendicular to the surfaces of the substrates 1 and 2.

As shown in FIGS. 5*a* and 5*b*, the main difference between this embodiment and Embodiment 1 is that the screen member 17 is provided between the pair of main discharge electrodes and the adjacent pair of main discharge electrodes. The screening member 17 is a pattern made of a transparent bandlike material extended in the same direction as the extending direction of the display electrodes 61 and 71. The screening member 17 is arranged so as to overlay at least a part of the top surface of the member of the barrier rib 11 formed in the lattice shape which is extended in the same direction as the extending direction of the display electrodes 61 and 71 as viewed from above the front substrate.

The screening member 17 is made of the same material as that of the bus electrodes 62 and 72 in this embodiment. When the mask used to photo-etch the Cr/Cu/Cr multi-layer at Step (1) mentioned above is changed, the screening member 17 can be formed at the same time with formation of the bus electrodes 62 and 72. Therefore, even if the screening member 17 is provided, the manufacturing process will not be made longer. The constitution other than this and the manufacturing method are the same as those of Embodiment 1.

According to this embodiment, the occupied area of the pattern made of a transparent material in the front substrate 1 is wider than that of Embodiment 1 and the top surface of the barrier rib 11 (white in this embodiment) which can be seen via the transparent material is almost covered by the screening member 17 and the bus electrodes 62 and 72 as viewed from above the front substrate 1. As a result, the integrity of the black display status of this embodiment is higher than that of Embodiment 1. The screening member 17 is formed so as to be overlaid on the barrier rib 11 contributing to no display, so that even if the screening member 17 is provided, the brightness will not be lowered. Therefore, the contrast of the gas discharge display unit of this embodiment becomes higher than that of Embodiment 1.

<EMBODIMENT 6>

The section of the gas discharge color display panel of this embodiment is shown in FIG. 6*a* to FIG. 6*c*. FIG. 6*a* is across sectional view of the display panel taken along line 6A—6A in FIG. 6*b* which is seen on a plane which is parallel with an address electrode 14 and perpendicular to the surfaces of substrates 1 and 2. FIG. 6*b* is a cross sectional view in the direction 6B shown in FIG. 6*a* and the section thereof is on a plane parallel with the surface of a glass plate 4 along the extending direction of bus electrodes 62 and 72. In FIG. 6*b*, display electrodes 61 and 191 are not sections, but are indicated by a pattern so as to make the drawing more understandable. FIG. 6*c* is a cross sectional view along the line 6C—6C shown in FIG. 6*a* and the section thereof is on a plane which is perpendicular to the address electrode 14 and perpendicular to the surfaces of the substrates 1 and 2.

As shown in FIG. 6, the main difference between this embodiment and Embodiment 1 is that three main discharge electrodes 6 and 19 are provided for each two display cell lines and the central electrode 19 among the three main discharge electrodes 6 and 19 is extended over two display cell lines. The bus electrode 192 of the main discharge common electrode 19 has branchlike members 18*b* on both sides. The bus electrode 62 of the main discharge non-common electrode 6 has a branchlike member 18*b* on one side and is arranged so that the side on which the branchlike member 18*b* is provided faces the main discharge common electrode 19. The bandlike member 18*a* of the bus electrode 192 of each common electrode 19 is formed above the member for making the display cell lines of the barrier rib 11 clear and the branchlike member 18*b* of each of the bus electrodes 62 and 192 is formed above the member of the barrier rib 11 for making each display cell on the display cell lines clear.

According to this embodiment, although the occupied area of the pattern made of a transparent material is wider than that of Embodiment 1 as viewed from the front, the area of the display cell 300 is not changed. The reason is that the top surface of the member along the display cell lines of the barrier rib 11 is covered with the bandlike electrode 18*a* of the bus electrode 192 of the common electrode 19 every other line. Therefore, in the display panel of this embodiment, the integrity of the black display status is higher than that of Embodiment 1.

According to Embodiment 1, the opening portion viewed from the front of the main discharge space 100 is partially covered with the bus electrode 72. However, according to this embodiment, the bus electrode 192 of the main discharge common electrode 19 is positioned above the barrier rib 11, so that the opening area as viewed from the front of the main discharge space 100 is wide. Therefore, in the gas discharge display panel of this embodiment, the brightness is higher than that of Embodiment 1.

From the aforementioned advantages, in the gas discharge display panel of this embodiment, a higher -contrast is obtained in comparison with Embodiment 1. In the case of this embodiment, the number of electrodes of the front substrate 1 is smaller than that of Embodiment 1 and they can be manufactured easily.

According to this embodiment, the display electrode 191 is a common electrode extending over the display cell lines. However, the display electrode 191 is not necessarily a common electrode but it is sufficient that the bus electrode 192 is a common electrode. In the panel of this embodiment, the electrode structure of the rear substrate is the same as that of Embodiment 1. However, the effect of this embodiment can be obtained regardless of the electrode structure of the rear substrate and the structure of one of the Embodiments 2 to 4 may be used.

In the display panel of this embodiment, the integrity of the black display status is inferior to that of the display panel of Embodiment 5, but the brightness is superior inversely.

<EMBODIMENT 7>

The section of the gas discharge color display panel of this embodiment is shown in FIG. 7*a* to FIG. 7*c*. FIG. 7*a* is a cross sectional view of the display panel taken along line 7A—7A of FIG. 7*b* which is seen on a plane which is parallel with an address electrode 14 and perpendicular to the surfaces of substrates 1 and 2. FIG. 7*b* is a cross sectional view in the direction 7B shown in FIG. 7*a* and the section thereof is a plane parallel with the surface of a glass plate 4 along the extending direction of bus electrodes 62 and 72. In FIG. 7*b*, display electrodes 61 and 191 and a screening member 17 are not sections, but are indicated by a pattern so as to make the drawing more understandable. FIG. 7*c* is a cross sectional view along the line 7C—7C shown in FIG. 7*a* and the section thereof is on a plane which is perpendicular to the address electrode 14 and perpendicular to the surfaces of the substrates 1 and 2.

As shown in FIGS. 7*a* and 7*b*, the main difference between this embodiment and Embodiment 6 is that the screen member 17 is provided between the main discharge non-common electrode 6 and the non-common electrode 6 of the adjacent display cell and the top surface of the barrier rib 11 viewed from front in Embodiment 6 is covered. The constitution other than this and the manufacturing method are the same as those of Embodiment 6.

According to this embodiment, although the occupied area of the pattern made of a transparent material is wider than that of Embodiment 6 as viewed from the front, the area of the display cell 300 is not changed. The reason is that all the top surface of the member along the display cell lines of the barrier rib 11 is covered with the bandlike electrode 18*a* of the bus electrode 192 or the screening member 17. Therefore, in the display panel of this embodiment, the integrity of the black display status is higher than that of Embodiment 6. Furthermore, the screening member 17 does not narrow the opening area viewed from the front of the main discharge space 100, so that even if the screening member 17 is provided, the brightness will not be lowered. Therefore, the contrast of the gas discharge display panel of this embodiment is higher than that of Embodiment 6.

When the display panel of this embodiment is compared with the display panel of Embodiment 5 having the screening member 17 in the same way, the occupied area of the screening member 17 as viewed from the front is the same. However, according to this embodiment, the bus electrode 192 of the main discharge common electrode 19 is positioned above the barrier rib 11, so that the opening area of the main discharge space 100 on the front side in this embodiment is wider than that of Embodiment 5. Therefore, the brightness of the gas discharge display panel of this embodiment is higher than that of the panel of Embodiment 5, so that the contrast is also higher. The screening member 17 is formed at the forming step of the bus electrodes 62 and 192 at the same time in the same way as with Embodiment 5, so that the number of manufacturing steps in this embodiment is the same as that of Embodiment 6.

<EMBODIMENT 8>

The section of the gas discharge color display panel of this embodiment is shown in FIGS. 8*a* to 8*c*. FIG. 8*a* is a cross sectional view of the display panel taken along line 8A—8A of FIG. 8*b* which is seen on a plane which is parallel with an address electrode 14 and perpendicular to the surfaces of substrates 1 and 2. FIG. 8*b* is a cross sectional view in the direction 8B shown in FIG. 8*a* and the section thereof is on a plane parallel with the surface of a glass plate 4 along the extending direction of bus electrodes 62 and 72. In FIG. 8*b*, display electrodes 61 and 191 are not sections, but are indicated by a pattern so as to make the drawing more understandable. FIG. 8*c* is a cross sectional view along the line 8C—8C shown in FIG. 8*a* and the section thereof is on a plane which is perpendicular to the address electrode 14 and perpendicular to the surfaces of the substrates 1 and 2.

As shown in FIG. 8*a*, the main difference between this embodiment and Embodiment 1 is that three main discharge electrodes 6 and 19 are provided for each display cell line, respectively, and the two electrodes 19 on both sides among the three main discharge electrodes 6 and 19 are common to the main discharge electrode 19 on the adjacent display cell line. According to this embodiment, the bus electrodes 62 and 192 have branchlike members 18*b* on both sides of the bandlike member 18*a* respectively. The constitution other than this and the manufacturing method are the same as those of Embodiment 1.

According to this embodiment, the bandlike member 18*a* of the bus electrode 192 of each common electrode 19 is formed above the member of the barrier rib 11 for making the display cell lines clear and the branchlike members 18*b* of each of the bus electrodes 62 and 192 are formed on the member of the barrier rib 11 for making each display cell on the display cell lines clear. The bandlike member 18*a* of the bus electrode 62 of each non-common electrode 6 is arranged so as to pass above the opening portion of the priming path 15 on the front substrate side. Therefore, as viewed from front, almost all of the overall top surface of the barrier rib 11 is covered with the bus electrodes 62 and 192 and the opening portion of the priming path 15 is covered with the bus electrode 62.

Therefore, even if the display panel of this embodiment is compared with the display panel of one of Embodiments 1 to 7, the aperture ratio of the main discharge space 100 as viewed from above the front substrate 1 is maximized and almost all of the overall surface of the portion around the main discharge space 100 which contributes to no display is covered with an opaque material. Therefore, compared with Embodiments 1 to 7, this embodiment can obtain a highest contrast.

According to this embodiment, a main discharge non-common electrode 6 is arranged at the center of each display cell as a main electrode for characterizing the display cell lines and a main discharge is generated by two electrode pairs formed on both sides of this common electrode 6. Therefore, according to this embodiment having the aforementioned constitution, the following effects (a) to (c) can be obtained.

(a) Two main discharges are generated by 2 sets of electrode pairs in the main discharge space 100 of each display cell, so that ultraviolet light generated in the main discharge space 100 increases in intensity and the discharge space spreads. As a result, the luminous intensity from the phosphor increases and the brightness and contrast can be increased further compared with Embodiment 1. According to this embodiment, particularly light emitted from the fluorescent layer 12 coated on the side wall of the barrier rib 11 contributes to the display effectively.

(b) According to this embodiment, the opening portion of the priming path 15 is covered with the bus electrode 62, so that the priming path 15 may be formed at the center of the main discharge space 100 and hence the bulkhead wall substrate 3 can be manufactured easily.

(c) A main discharge of each display cell is generated between two electrode pairs, so that even if a slight dislocation exists between the bulkhead wall substrate 13 for forming the main discharge space 100 and the front substrate 1, a main discharge corresponding to each display cell can be generated and the bulkhead wall substrate 13 and the front substrate 1 can be assembled easily.

In the same way as with Embodiment 6, the display electrode 191 of the common electrode 19 does not necessarily extend over two cell lines and it is sufficient that the bus electrode 192 is a common electrode. In the same way as with Embodiment 1, it is not necessary to continue the display electrodes 61 and 191 along the display cells and it is possible to form each display electrode as an independent electrode for each discharge cell and connect each display electrode with the bus electrodes 62 and 192.

<EMBODIMENT 9>

Figure 11A:
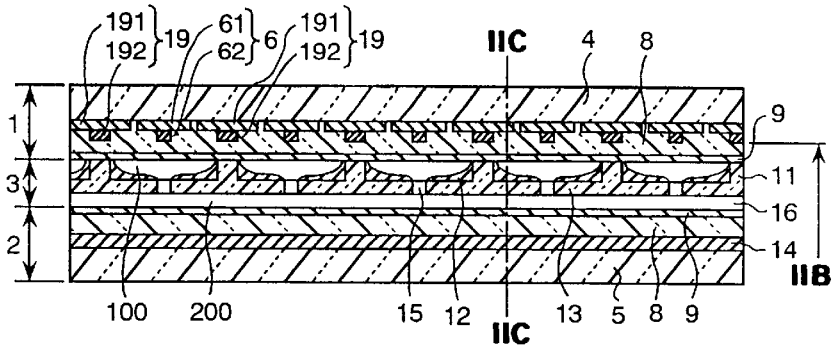
FIGS. 11*a*, 11*b*, and 11*c* are partially enlarged cross-sectional views of the gas discharge display panel of Embodiment 9.
Figure 11B:
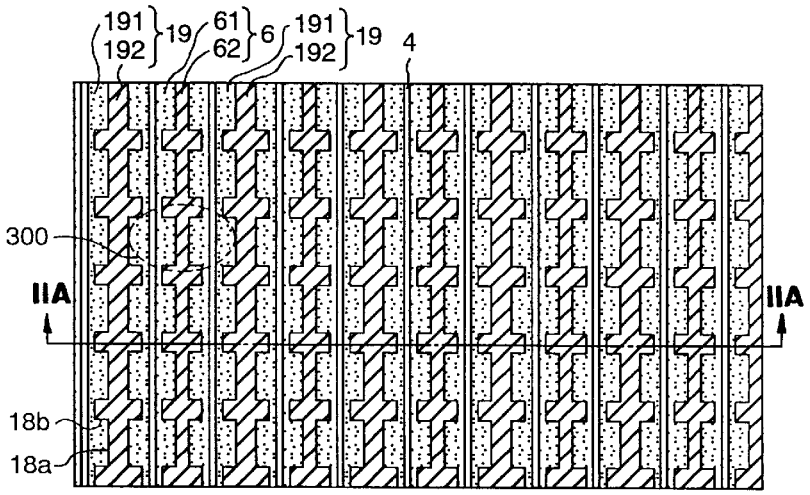
Figure 11C:
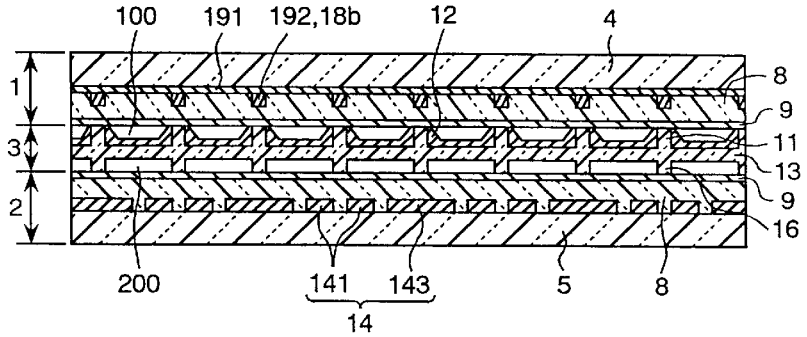

The section of the gas discharge color display panel of this embodiment is shown in FIGS. 11*a* to 11*c*. FIG. 11*a* is a cross sectional view of the display panel taken along line 11A—11A of FIG. 11*b* as seen on a plane which is parallel with an address electrode 14 and perpendicular to the surfaces of substrates 1 and 2. FIG. 11*b* is a cross sectional view in the direction 11B shown in FIG. 11*a* and the section thereof is on a plane parallel with the surface of a glass plate 4 along the extending direction of bus electrodes 62 and 72. In FIG. 11*b*, display electrodes 61 and 191 are not sections, but are indicated by a pattern so as to make the drawing more understandable. FIG. 11*c* is a cross sectional view along the line 11C—11C shown in FIG. 11*a* and the section thereof is on a plane which is perpendicular to the address electrode 14 and perpendicular to the surfaces of the substrates 1 and 2.

As shown in FIG. 11*c*, only the constitution of the auxiliary discharge electrode 14 formed on the rear substrate 2 is different in this embodiment from Embodiment 8. According to this embodiment, three auxiliary discharge electrodes 14 are provided for each two auxiliary discharge cell lines and the central one electrode 143 among the three auxiliary discharge electrodes 14 is provided so as to extend over two auxiliary discharge cell lines.

In the display panel of this embodiment, when a voltage is applied between the auxiliary discharge non-common electrode 141 and the main electrode 6, a display cell is selected. The auxiliary discharge common electrode 143 is provided so as to be positioned under the barrier rib 16 for making the auxiliary discharge space 200 of each display cell on the display cell lines clear.

In the case of this embodiment, one electrode of the pair of auxiliary discharge electrodes is shared by two auxiliary discharge cell lines, so that the number of auxiliary discharge electrodes can be reduced. When the size of the shared auxiliary discharge electrode 143 is made smaller, the area of the unshared auxiliary discharge electrode 141 which is overlaid on the priming path 15 can be made larger. As a result, the priming path 15 can be positioned easily. Therefore, the size of the priming path 15 can be made smaller, so that the contrast can be made higher and the manufacturing process of this embodiment is stabilized even more as compared with Embodiment 8.

As this embodiment shows, by use of the same main discharge electrode as that of Embodiment 8, the same effect as that of Embodiment 8 can be obtained regardless of the structure of the rear substrate 2.

<EMBODIMENT 10>

Figure 12A:
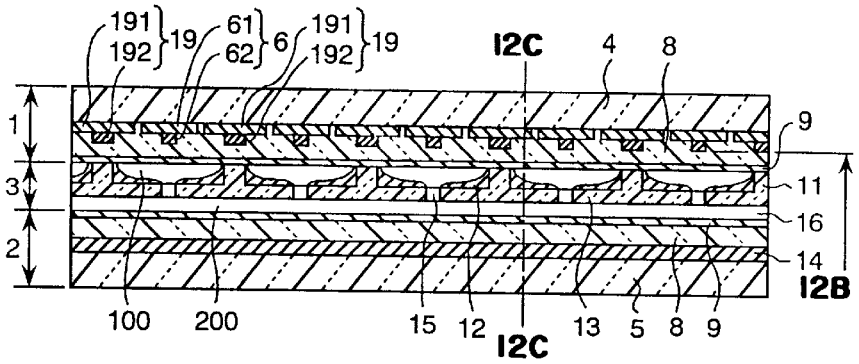
FIGS. 12*a*, 12*b*, and 12*c* are partially enlarged cross-sectional views of the gas discharge display panel of Embodiment 10.
Figure 12B:
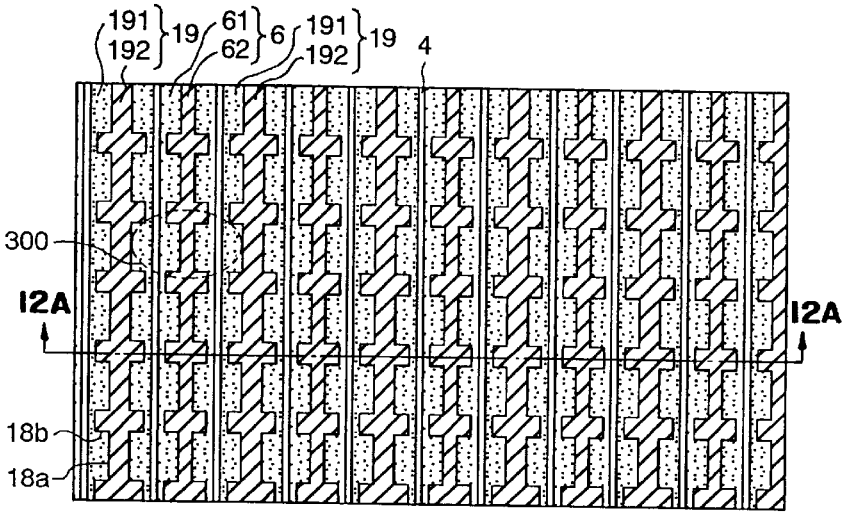
Figure 12C:
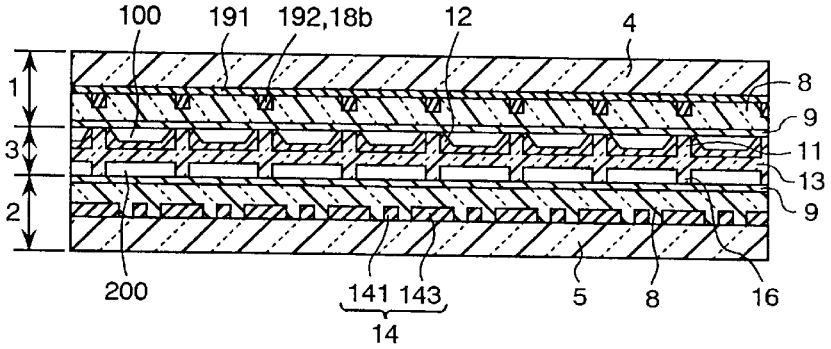

The section of the gas discharge color display panel of this embodiment is shown in FIGS. 12*a* to 12*c*. FIG. 12*a* is a cross sectional view of the display panel taken along line 12A—12A of FIG. 12*b* as seen on a plane which is parallel with an address electrode 14 and perpendicular to the surfaces of substrates 1 and 2. FIG. 12*b* is a cross sectional view in the direction 12B shown in FIG. 12*a* and the section thereof is on a plane parallel with the surface of a glass plate 4 along the extending direction of bus electrodes 62 and 72. In FIG. 12*b*, display electrodes 61 and 191 are not sections, but are indicated by a pattern so as to make the drawing more understandable. FIG. 12*c* is a cross sectional view along the line 12C—12C shown in FIG. 12*a* and the section thereof is a plane which is perpendicular to the address electrode 14 and perpendicular to the surfaces of the substrates 1 and 2.

As shown in FIGS. 12*a*–12*c*, the display panel of this embodiment has a front substrate 1 which is the same as that of Embodiment 8, a bulkhead wall substrate 3 which is the same as that of Embodiment 1, and a rear substrate 2 which is the same as that of Embodiment 3. According to this embodiment, a high contrast which is the same as that of Embodiment 8 is obtained and furthermore an effect obtained when an auxiliary discharge is generated between 2 sets of auxiliary discharge electrode pairs which is the same as that of Embodiment 8 is obtained.

<EMBODIMENT 11>

Figure 13A:
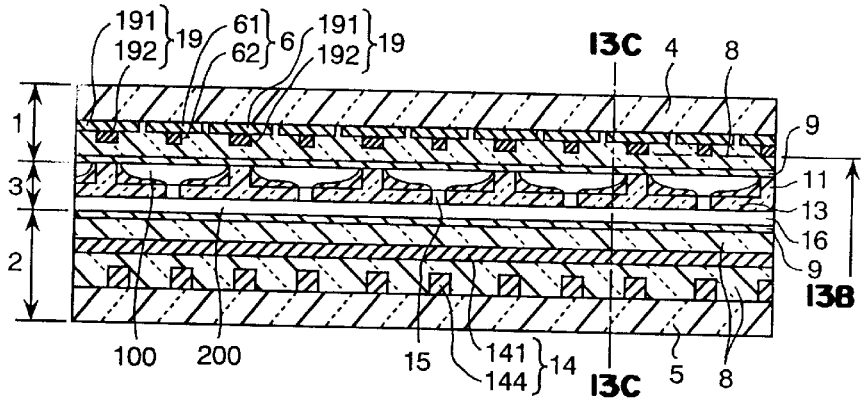
FIGS. 13*a*, 13*b*, and 13*c* are partially enlarged cross-sectional views of the gas discharge display panel of Embodiment 11.
Figure 13B:
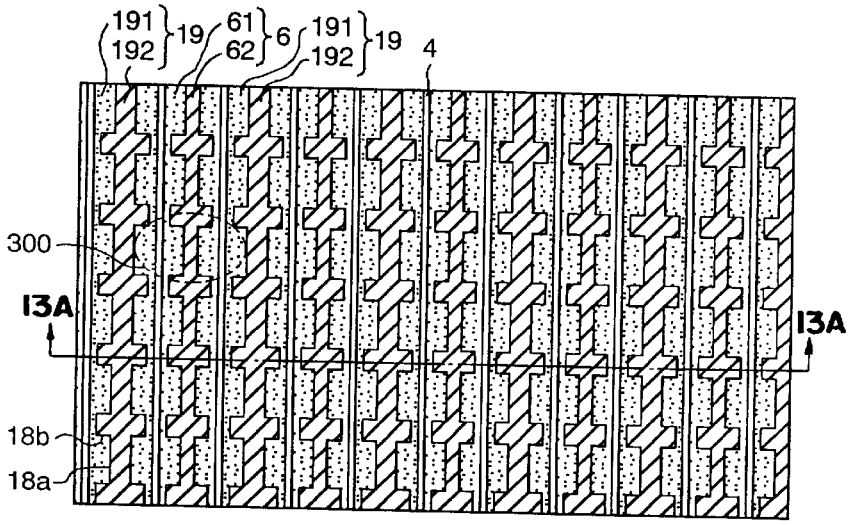
Figure 13C:
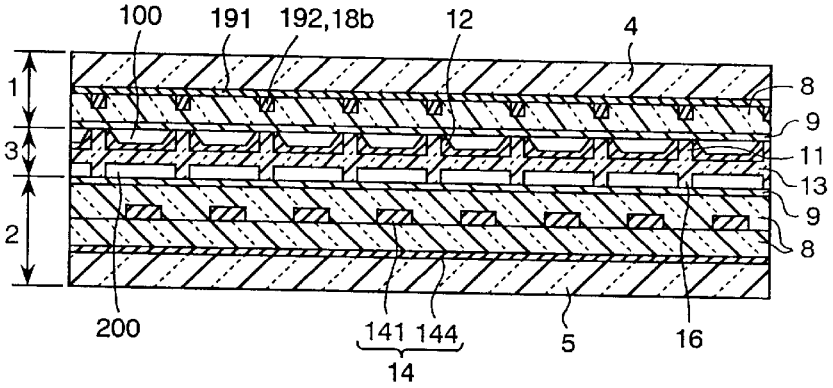

The section of the gas discharge color display panel of this embodiment is shown in FIGS. 13*a* to 13*c*. FIG. 13*a* is a cross sectional view of the display panel taken along line 13A—13A of FIG. 13*b* as seen on a plane which is parallel with an address electrode 141 and perpendicular to the surfaces of substrates 1 and 2. FIG. 13*b* is a cross sectional view in the direction 13B shown in FIG. 13*a* and the section thereof is on a plane parallel with the surface of a glass plate 4 along the extending direction of bus electrodes 62 and 72. In FIG. 13*b*, display electrodes 61 and 191 are not sections, but are indicated by a pattern so as to make the drawing more understandable. FIG. 13*c* is a cross sectional view along the line 13C—13C shown in FIG. 13*a* and the section thereof is on a plane which is perpendicular to the address electrode 14 and perpendicular to the surfaces of the substrates 1 and 2.

As shown in FIGS. 12*a*–12*c* the display panel of this embodiment has a front substrate 1 which is the same as that of Embodiment 8, a bulkhead wall substrate 3 which is the same as that of Embodiment 1, and a rear substrate 2 which is the same as that of Embodiment 4. According to this embodiment, a high contrast which is the same as that of Embodiment 8 is obtained and furthermore an effect obtained when an auxiliary discharge is generated between a pair of auxiliary discharge electrodes 141 and 144 crossing each other which is the same as that of Embodiment 4 is obtained.

<EMBODIMENT 12>

In Embodiments 1 to 11 mentioned above, examples wherein the present invention is applied to a gas discharge display panel having the bulkhead wall 13 have been explained. However, the present invention can be applied also to a gas discharge display panel having no bulkhead wall 13, as in this embodiment.

Figure 14A:
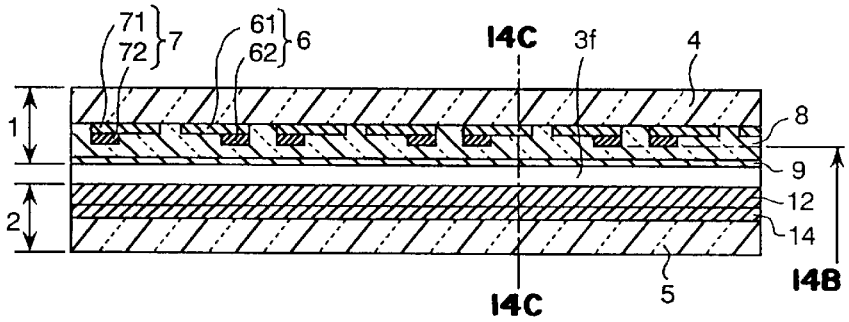
FIGS. 14*a*, 14*b*, and 14*c* are partially enlarged cross-sectional views of the gas discharge display panel of Embodiment 12.
Figure 14B:
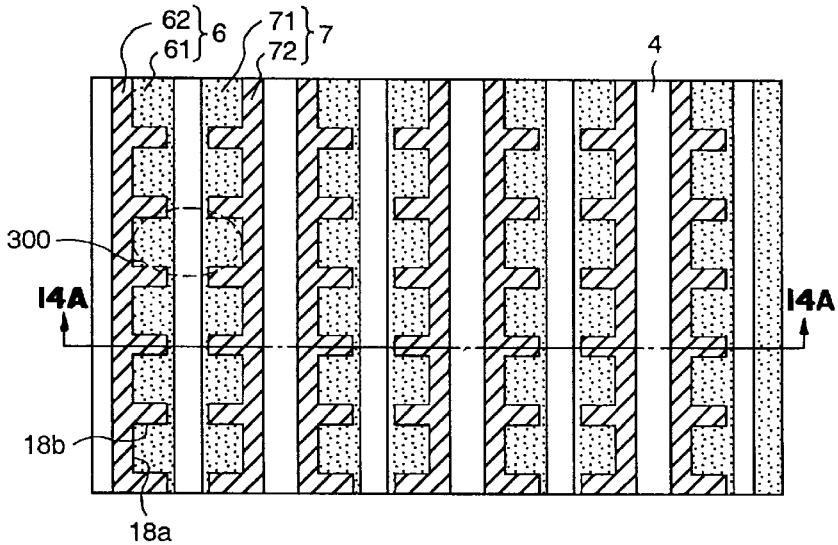
Figure 14C:
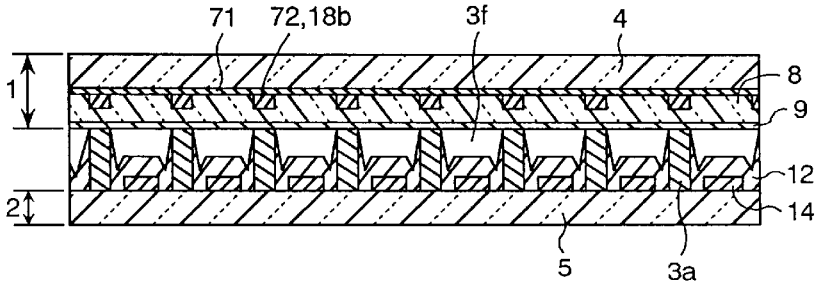

The cross sectional views of the gas discharge color display panel of this embodiment are shown in FIGS. 14*a* to 14*c*. FIG. 14*a* is a cross sectional view of a part of the display panel taken along line 14A—14A of FIG. 14*b* of this embodiment as seen on a plane which is parallel with an address electrode 14 and perpendicular to the surfaces of substrates 1 and 2. FIG. 14*b* is a cross sectional view in the direction 14B shown in FIG. 14*a* and the section thereof is on a plane which is perpendicular address electrode 14 and perpendicular to the surfaces of the substrates 1 and 2. FIG. 14*c* is a cross sectional view in the direction of line 14C—14C shown in FIG. 14*a* and the section thereof is on a plane which is perpendicular to the address electrode 14 and perpendicular to the surfaces of the substrates 1 and 2. In FIGS. 14*a* to 14*c*, only the sections are shown and illustration of the constitution which will be seen behind each view is omitted.

Figure 22:
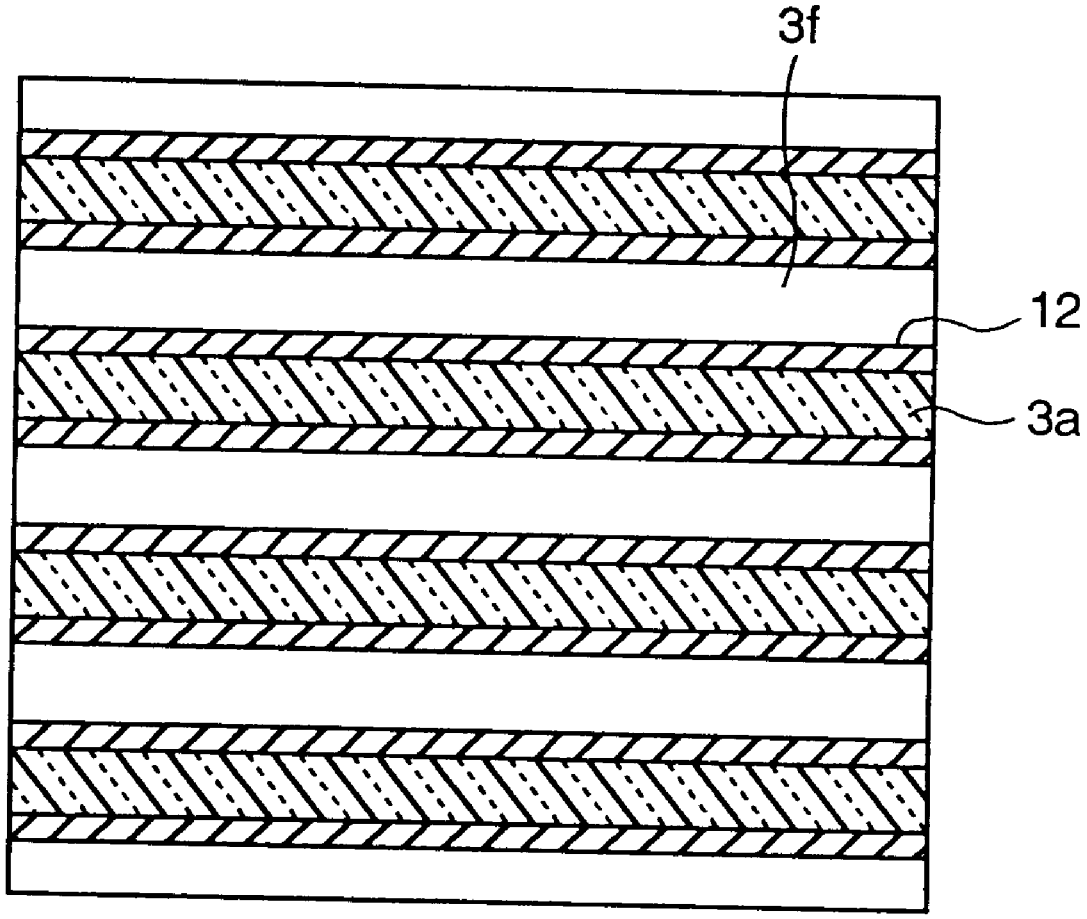
FIG. 22 PRIOR ART
FIG. 22 is a partially enlarged perspective view showing the structure of barrier ribs in a conventional example of a gas discharge display panel.

As shown in FIGS. 14*b* and 14*c*, a display cell 300 is formed between both substrates 1 and 2 for each set of display electrodes 61 and 71 and a discharge space 3*f* is formed by both substrates 1 and 2 and the barrier rib 3*a*. Inside this display cell, a fluorescent layer 12 is formed. In the space 3*f* in the cell, discharge gas is charged. In the display panel of this embodiment, the barrier ribs 3*a* are parallel bar-shaped ribs similar to those shown in FIG. 22 and the discharge spaces 3*f* of the display cells on the auxiliary discharge cell lines are not separated by the barrier ribs 3*a*.

Figure 10A:
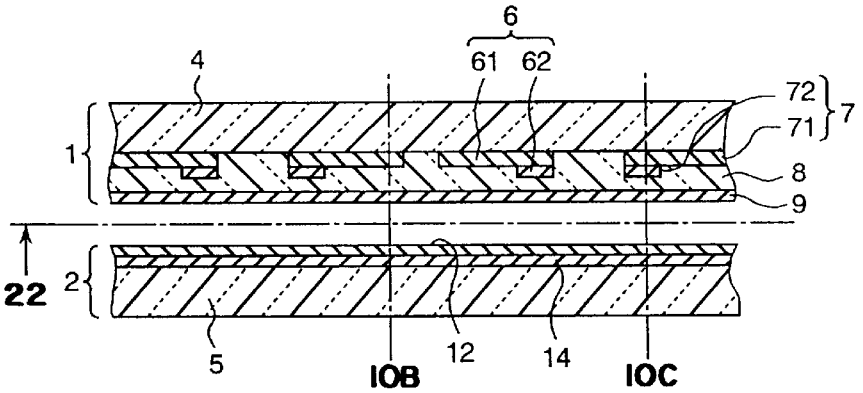
FIG. 10a PRIOR ART
FIGS. 10*a*, 10*b*, and 10*c* are partially enlarged cross-sectional views showing conventional examples of a gas discharge display panel.
Figure 10B:
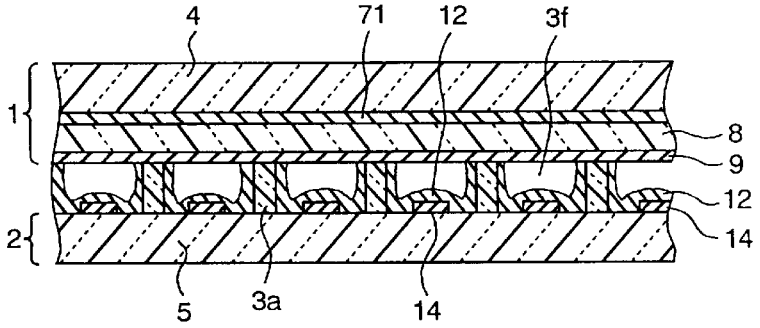
FIG. 10b PRIOR ART
Figure 10C:
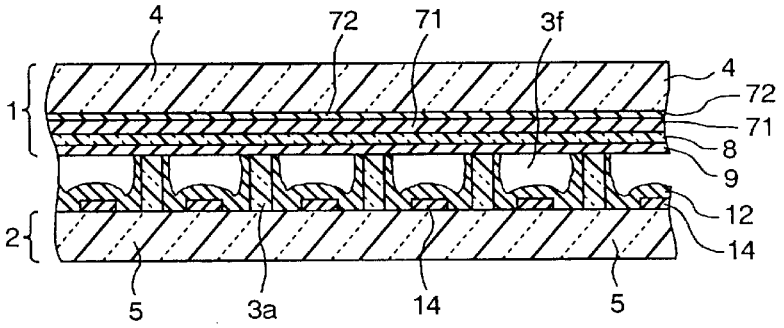
FIG. 10c PRIOR ART

The bus electrodes 62 and 72 of the display panel of this embodiment, as shown in FIG. 14*b*, have the same shape as that of the bus electrodes 62 and 72 of Embodiment 1 and constitute the frame of the display cell 300 in the same way as Embodiment 1. Therefore, color bleeding and mixture of display are suppressed by this frame and the integrity of the black display status is higher than that of the conventional display panel shown in FIG. 10, so that a higher contrast is obtained. Furthermore, the branchlike members 18*b* of the bus electrodes 62 and 72 having a low resistance are extended toward the opposite electrodes on the barrier ribs 3*a* and hence the whole resistance of the display electrodes 6 and 7 can be lowered.

The display panel of this embodiment does not have the bulkhead wall substrate 3. Therefore, the manufacturing method of the display panel of this embodiment will be explained next.

Firstly, on the rear glass substrate 5 made of soda lime glass washed using a neutral detergent and other materials, a predetermined pattern is printed using silver paste by a thick film printing method, and it is dried at 100 to 150° C., and then sintered at 500 to 600° C. and the address electrodes 14 are formed.

On this substrate, barrier rib forming paste is printed in a predetermined pattern by the thick film printing method and dried at 100 to 150° C. It is required to make the barrier ribs 3*a* thicker, so that the printing and drying of this barrier rib forming paste are repeated several times, and the paste is sintered at 500 to 600° C., and the barrier ribs 3*a* are formed.

Furthermore, red, blue, or green phosphor paste is printed on the side of the barrier ribs, the surface of the glass plate 5, and the surface of the address electrodes 14 constituting the inner wall of each discharge cell formed by the barrier ribs 3*a* by a thick film printing method, and this is dried at 100 to 150° C., and sintered at 500 to 600° C. and the fluorescent layer 12 is formed.

Finally, the rear substrate 2 having the barrier ribs 3*a* and the fluorescent layer 12 which is prepared as mentioned above and the front substrate 1 which is prepared in the same way as Embodiment 1 are positioned so that they face each other and gas is charged in the same way as the assembly process of Embodiment 1.

According to this embodiment, the address electrodes 14 are formed by a thick film printing method. However, as shown in Embodiments 1 to 11, they may be formed by an evaporation method, such as a sputtering method or an electron beam evaporation method. As a material of the address electrodes 14, copper or aluminum, or one of them sandwiched between high melting point metals, such as chromium, titanium, nickel, tungsten, or molybdenum, may be used. The barrier ribs 3*a* are prepared by repeating printing, drying, and sintering of thick film paste. However, the barrier ribs 3*a* may be formed by coating thick film paste thickly over all of the surface, forming a resist layer of photosensitive resin having the predetermined pattern on it, and removing the unnecessary area by a sandblasting method or by forming a resist layer and then embedding barrier rib paste. Furthermore, formation of the fluorescent layer 12 is not limited to the thick film printing method, and so a spray method may be used.

<EMBODIMENT 13>

Figure 15A:
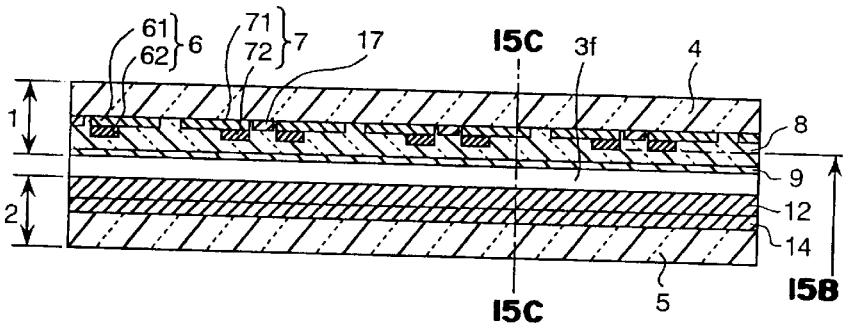
FIGS. 15*a*, 15*b*, and 15*c* are partially enlarged cross-sectional views of the gas discharge display panel of Embodiment 13.
Figure 15B:
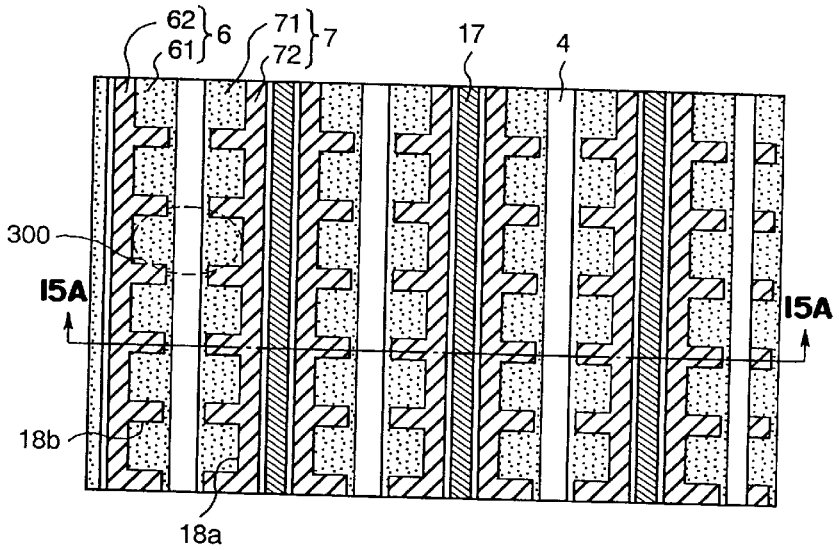
Figure 15C:
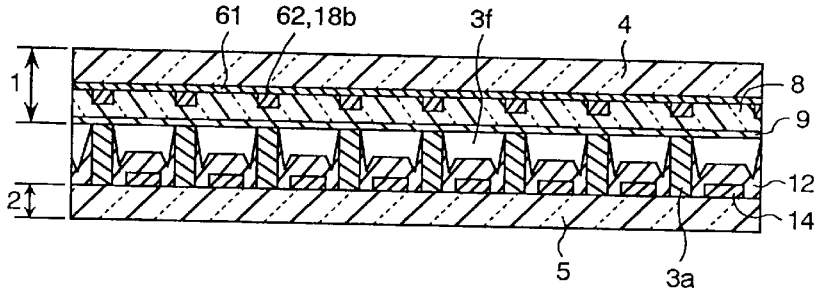

The cross sectional views of the gas discharge color display panel of this embodiment are shown in FIGS. 15*a* to 15*c*. FIG. 15*a* is a cross sectional view of a part of the display panel taken along line 15A—15A of FIG. 15*b* of this embodiment as seen on a plane which is parallel with an address electrode 14 and perpendicular to the surfaces of substrates 1 and 2. FIG. 15*b* is a cross sectional view in the direction A shown in FIG. 15*a* and the section thereof is on a plane which is perpendicular to the address electrode 14 and perpendicular to the surfaces of the substrates 1 and 2. In FIG. 15*b*, display electrodes 61 and 191 and a screening member 17 are not sections, but are indicated by a pattern so as to make the drawing more understandable. FIG. 15*c* is a cross sectional view in the direction of the line 15C—15C shown in FIG. 15*a* and the section thereof is on a plane which is perpendicular to the address electrode 14 and perpendicular to the surfaces of the substrates 1 and 2. In FIGS. 15*a* to 15*c*, only the sections are shown and illustration of the constitution which will be seen behind each view is omitted.

The display panel of this embodiment is different from Embodiment 12 only in the point that it has the screening member 17 similar to Embodiment 5. Even in this embodiment, as with Embodiment 5, since the display panel has the screening member 17, the integrity of the black display status is improved without the brightness being lowered.

<EMBODIMENT 14>

Figure 16A:
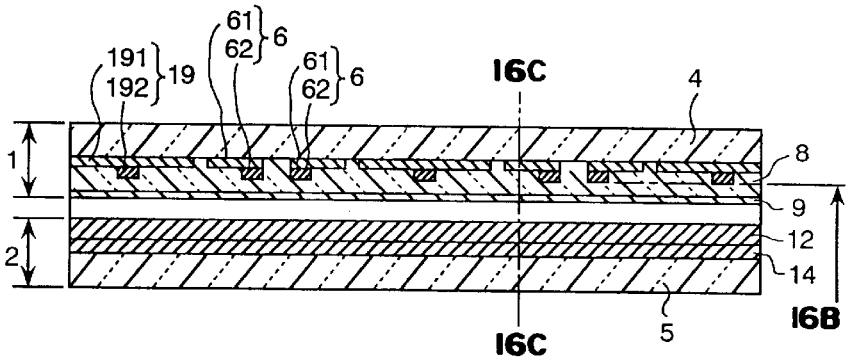
FIGS. 16*a*, 16*b*, and 16*c* are partially enlarged cross-sectional views of the gas discharge display panel of Embodiment 14.
Figure 16B:
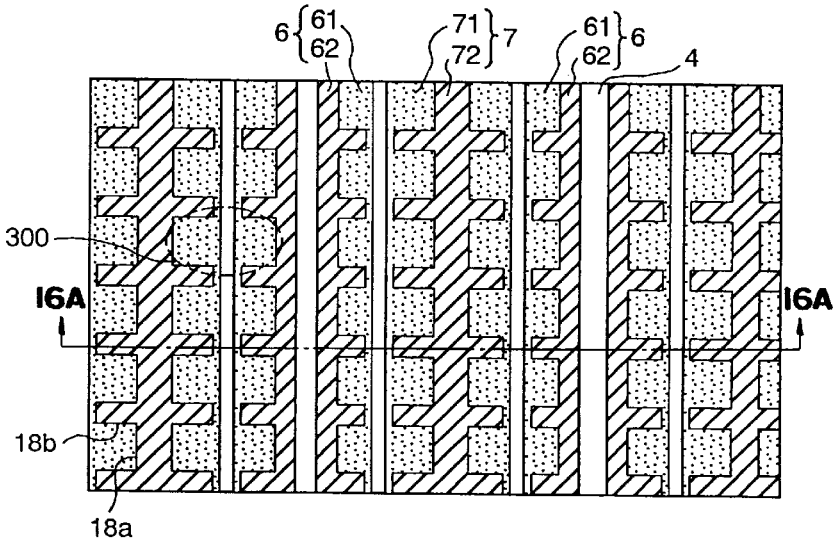
Figure 16C:
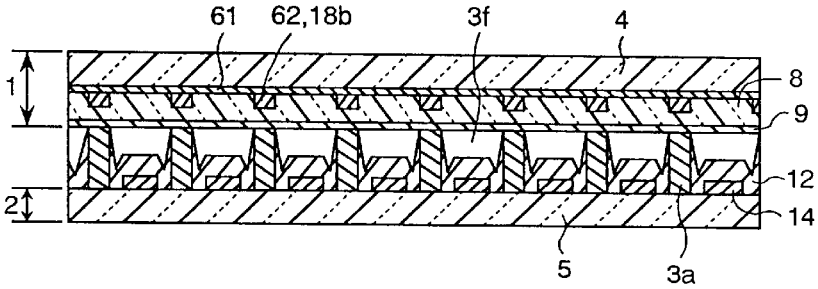

The cross sectional views of the gas discharge color display panel of this embodiment are shown in FIGS. 16*a* to 16*c*. FIG. 16*a* is a cross sectional view of a part of the display panel taken along line 16A—16A of FIG. 16*b* of this embodiment as seen on a plane which is parallel with an address electrode 14 and perpendicular to the surfaces of substrates 1 and 2. FIG. 16*b* is a cross sectional view in the direction 16B shown in FIG. 14*a* and the section thereof is on a plane which is perpendicular to the address electrode 14 and perpendicular to the surfaces of the substrates 1 and 2. FIG. 16*c* is a cross sectional view in the direction of line 16C—16C shown in FIG. 16*a* and the section thereof is on a plane which is perpendicular to the address electrode 14 and perpendicular to the surfaces of the substrates 1 and 2. In FIGS. 16*a* to 16*c*, only the sections are shown and illustration of the constitution which will be seen behind each view is omitted.

The display panel of this embodiment is different from Embodiment 12 only in the point that the constitution of the main discharge electrode is the same as that of Embodiment 6. Even in this embodiment, in the same way as Embodiment 6, since the bus electrode 192 of the common electrode 19 covers the top surface of the barrier ribs 3*a*, the integrity of the black display status and the brightness are improved.

<EMBODIMENT 15>

Figure 17A:
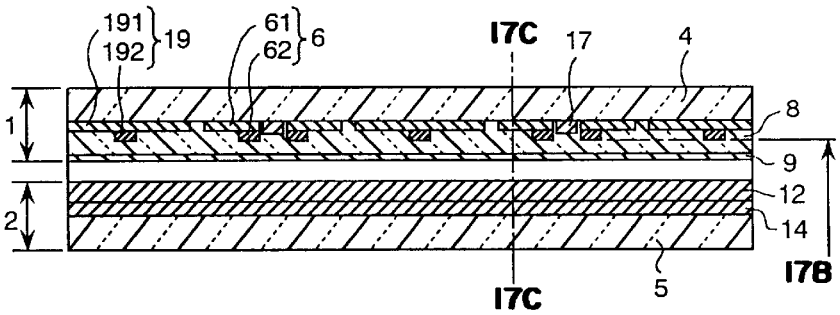
FIGS. 17*a*, 17*b*, and 17*c* are partially enlarged cross-sectional views of the gas discharge display panel of Embodiment 15.
Figure 17B:
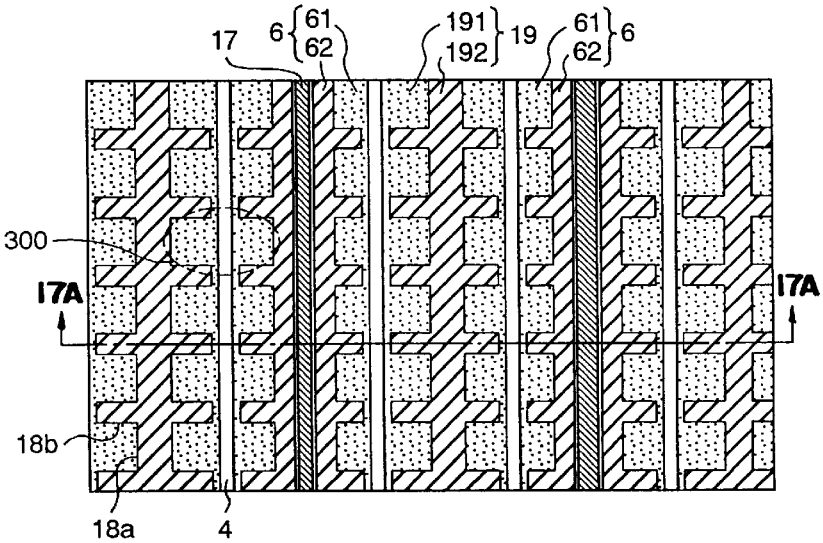
Figure 17C:
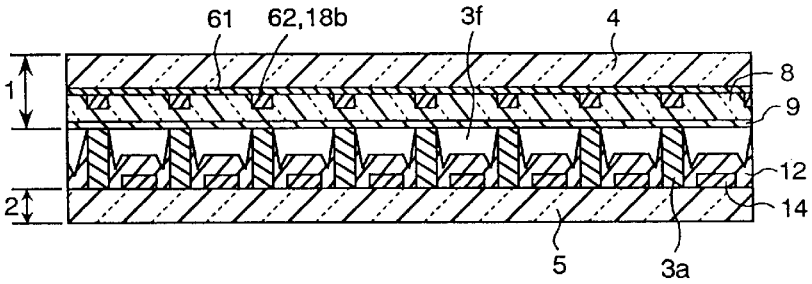

The cross sectional views of the gas discharge color display panel of this embodiment are shown in FIGS. 17*a* to 17*c*. FIG. 17*a* is a cross sectional view of a part of the display panel of this embodiment taken along line 17A—17A of FIG. 17*b* as seen on a plane which is parallel with an address electrode 14 and perpendicular to the surfaces of substrates 1 and 2. FIG. 17*b* is a cross sectional view in the direction 17B shown in FIG. 17*a* and the section thereof is on a plane which is perpendicular to the address electrode 14 and perpendicular to the surfaces of the substrates 1 and 2. In FIG. 17*b*, display electrodes 61 and 191 and a screening member 17 are not sections, but are indicated by a pattern so as to make the drawing more understandable. FIG. 17*c* is a cross sectional view in the direction of line 17C—17C shown in FIG. 17*a* and the section thereof is on a plane which is perpendicular to the address electrode 14 and perpendicular to the surfaces of the substrates 1 and 2. In FIGS. 17*a* to 17*c*, only the sections are shown and illustration of the constitution which will be seen behind each view is omitted.

The display panel of this embodiment is different from the Embodiment 12 only in the point that the front substrate 1 has the common electrode 19 and the screening member 17 in the same way as Embodiment 7. Even in this embodiment, in the same way as Embodiment 7, since the front panel 1 has the screening member 17 in the same way as Embodiment 7, the integrity of the black display status is improved without the brightness being lowered, and since one electrode 19 of the pair of main discharge electrodes is set as a common electrode and the bus electrode 192 of this electrode 19 covers the top surface of the barrier ribs 3*a*, the integrity of the black display status and the brightness are improved.

<EMBODIMENT 16>

Figure 18A:
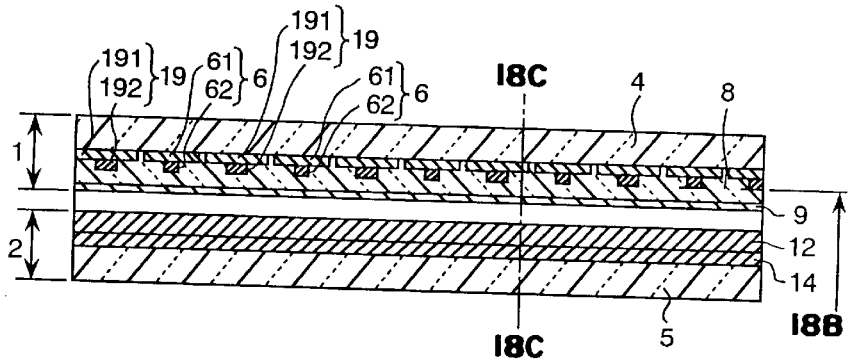
FIGS. 18*a*, 18*b*, and 18*c* are partially enlarged cross-sectional views the gas discharge display panel of Embodiment 16.
Figure 18B:
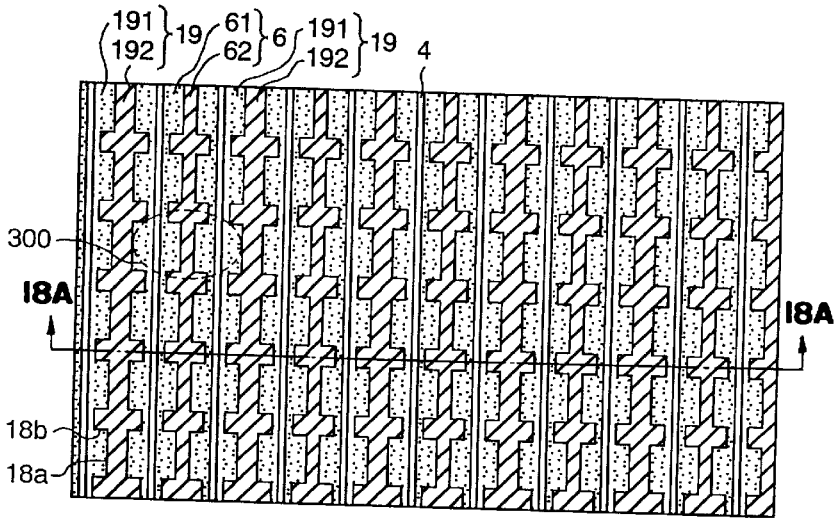
Figure 18C:
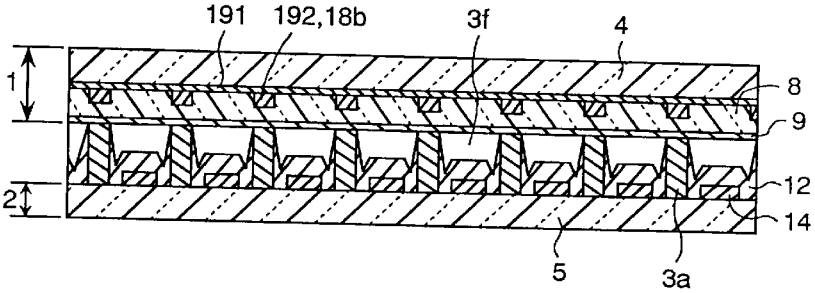

The cross sectional views of the gas discharge color display panel of this embodiment are shown in FIGS. 18*a* to 18*c*. FIG. 18*a* is a cross sectional view of a part of the display panel taken along line 18A—18A of FIG. 18*b* of this embodiment as seen on a plane which is parallel with an address electrode 14 and perpendicular to the surfaces of substrates 1 and 2. FIG. 18*b* is a cross sectional view in the direction 18B shown in FIG. 18*a* and the section thereof is on a plane which is perpendicular to the address electrode 14 and perpendicular to the surfaces of the substrates 1 and 2. FIG. 18*c* is a cross sectional view in the direction of line 18C—18C shown in FIG. 18*a* and the section thereof is on a plane which is perpendicular to the address electrode 14 and perpendicular to the surfaces of the substrates 1 and 2. In FIGS. 18*a* to 18*c*, only the sections are shown and illustration of the constitution which will be seen behind each view is omitted.

The display panel of this embodiment is different from the Embodiment 12 only in the point that the front substrate 1 has two common electrodes 19 and one non-common electrode 6 for each display cell line in the same way as Embodiment 8. Even in this embodiment, an increase in the luminous intensity, an increase in the aperture ratio of the discharge space 3*f*, and stabilization of the manufacturing process by generating a main discharge by two sets of main discharge electrode pairs, an increase in the contrast to provide an improvement of the integrity of black display status and the brightness, and also an effect of stabilization of the manufacturing process by providing two sets of main discharge electrode pairs for one discharge cell line are obtained.

<EMBODIMENT 17>

Figure 19A:
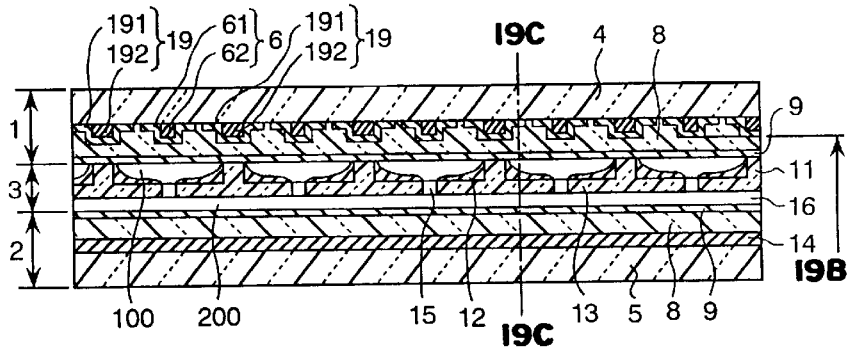
FIGS. 19*a*, 19*b*, and 19*c* are partially enlarged cross-sectional views of the gas discharge display panel of Embodiment 17.
Figure 19B:
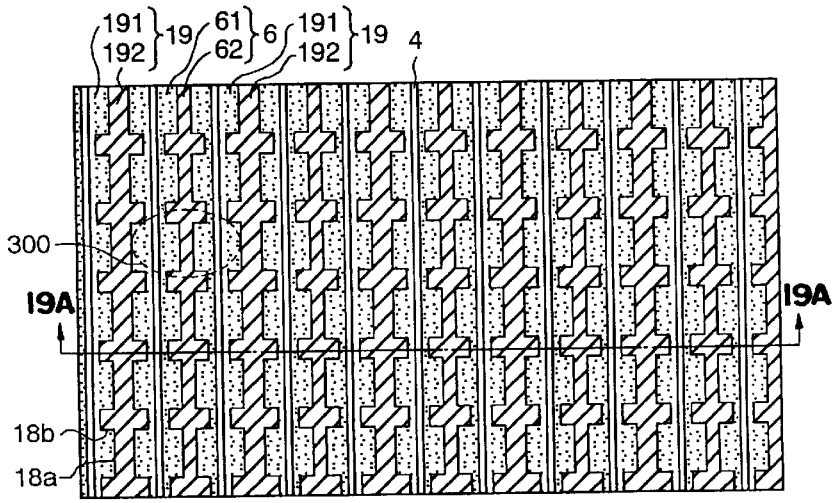
Figure 19C:
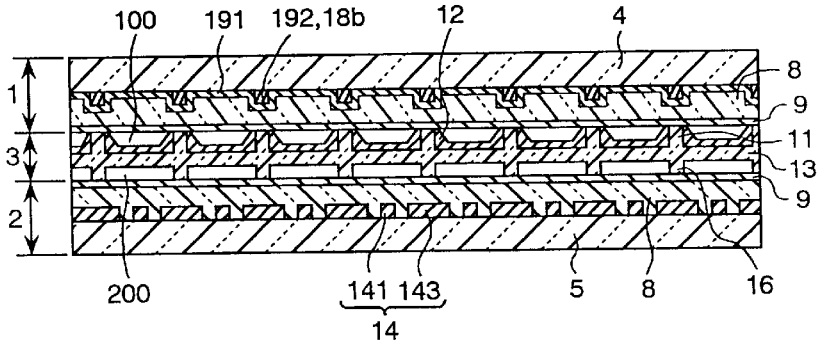

The section of the gas discharge color display panel of this embodiment is shown in FIGS. 19*a* to 19*c*. FIG. 19*a* is a cross sectional view of the display panel taken along line 19A—19A of FIG. 19*b* as seen on a plane which is parallel with an address electrode 14 and perpendicular to the surfaces of substrates 1 and 2. FIG. 19*b* is a cross sectional view in the direction 19B shown in FIG. 19*a* and the section thereof is a plane which is parallel with the surface of a glass plate 4 along the extending direction of bus electrodes 62 and 192. In FIG. 19*b*, display electrodes 61 and 191 are not sections, but are indicated by hatching so as to make the drawing more understandable. FIG. 19*c* is a cross sectional view along the line 19C—19C shown in FIG. 19*a* and the section thereof is on a plane which is perpendicular to the address electrode 14 and perpendicular to the surfaces of the substrates 1 and 2.

As shown in FIGS. 19*a*–19*c*, the main difference between this embodiment and Embodiment 10 is that the depositing order of the display electrodes (transparent electrodes) 61 and 191 and the bus electrodes 62 and 192 is reverse. Namely, the front substrate 1 of Embodiment 10 is formed in the order of the glass plate 4, the display electrodes 61 and 191, the bus electrodes 62 and 192, the dielectric layer 8, and the protective film 9. On the other hand, the front substrate 1 of this embodiment is formed in the order of the glass plate 4, the bus electrodes 62 and 192, the display electrodes 61 and 191, the dielectric layer 8, and the protective film 9.

Figure 20A:
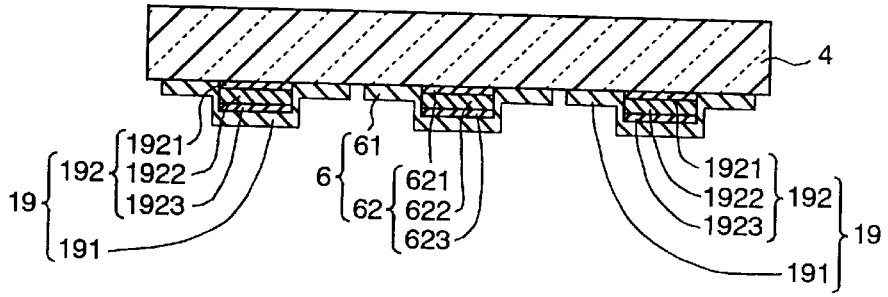
FIGS. 20*a* and 20*b* are partially enlarged cross-sectional views of the front substrate of Embodiment 17 and an application example thereof.

The section of the front substrate 1 of this embodiment is shown in FIG. 20*a*. However, in FIG. 20*a*, illustration of the dielectric layer 8 and the protective film 9 is omitted. The bus electrodes 62 and 192 of this embodiment are formed directly on the surface of the glass plate 4 and in the same way as with Embodiment 10, they comprise a multi-layer arrangement of first high melting point metal layers 621 and 1921, low melting point metal layers 622 and 1922, and second high melting point metal layers 623 and 1923 which are deposited in this order. According to this embodiment, the first high melting point metal layers 621 and 1921 and the second high melting point metal layers 623 and 1923 are made of Cr and the low melting point metal layers 622 and 1922 are made of Cu.

When the bus electrodes 62 and 72 are structured so as to function as a black matrix (black mask) for making the display cells 300 clear on the front of the display panel, it is desirable to reduce the reflection of the incident light from the front substrate 1 side on the surface of the bus electrodes so as to improve the integrity in the black display status. Therefore, according to this embodiment, the surfaces of the first high melting point metal layers 621 and 1921 on the glass plate 4 side are covered with an oxide film of the high melting point metal. By doing this, the metallic luster of the surfaces of the bus electrodes 62 and 19Z is lost and hence the reflection is suppressed, so that the quality of a displayed picture is improved.

Figure 20B:
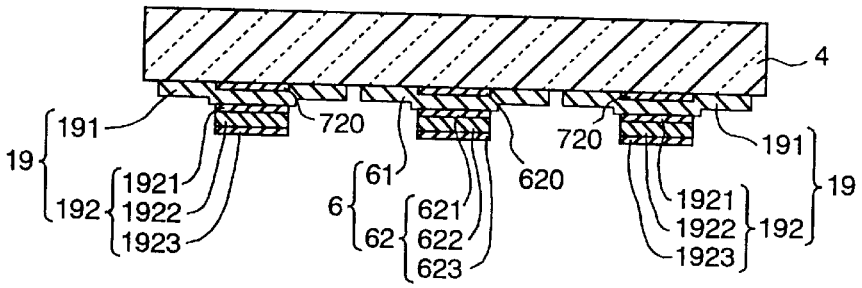

When the thin film layer constituting the bus electrodes 62 and 72 is thicker than the thin film layer constituting the display electrodes (transparent electrodes) 61 and 71, the coverage of the transparent electrode patterns 61 and 71 against the bus electrode patterns 62 and 72 is not good and disconnected portions may be generated or a large resistance may be generated. If this occurs, it is necessary to form the glass plate 4, the display electrodes 61 and 191, and the bus electrodes 62 and 192 in this order in the same way as with Embodiment 10. Therefore, as shown in FIG. 20*b*, it is possible to form screening layers 620 and 720 made of a high melting point metal oxide between the glass plate 4 and the display electrodes 61 and 191 and to cover the front of the bus electrodes 62 and 192 with the screening layers 620 and 720. In this case, it is desirable to set the layer thickness of the screening layers 620 and 720 so that the reflectance is made smaller on the basis of the refractivity index and plate thickness of the front glass plate 4, the refractivity index and layer thickness of the ITO layers 61 and 191, the refractivity index of the high melting point metal, and the refractivity index of the high melting point metal oxide.

In the display panel of this embodiment, not only the manufacturing process explained in Embodiment 1 and the electrode pattern, but also the electrode forming process (Step (1)) of the front substrate 1 are different. Therefore, the electrode forming process of the front substrate 1 will be explained next by referring to FIGS. 21*a*–21*c*.

Figure 21A:
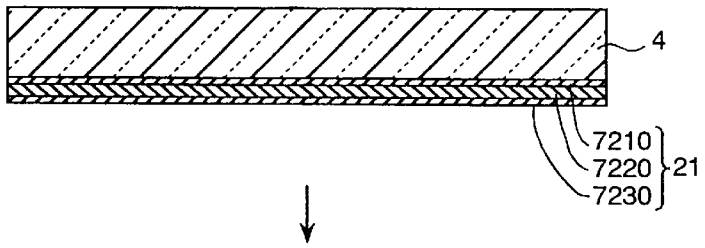
FIGS. 21*a*, 21*b*, 21*c*, and 21*d* are diagrams showing steps of the preparation process of the main discharge electrode of Embodiment 17.
Figure 21B:
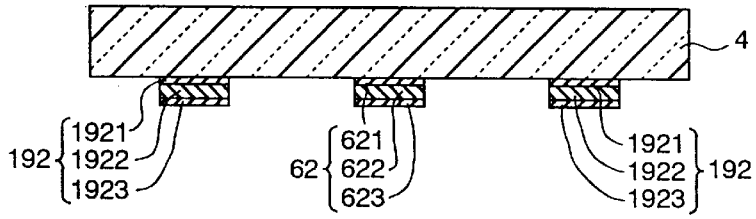

Firstly, on one of the front and back surfaces of a soda lime glass plate 4 (width of about 85 cm, depth of about 70 cm, thickness of about 2.8 mm) which is washed using a neutral detergent and other materials, a chromium oxide film, a chromium film 7210, a copper film 7220, and a chromium film 7230 are formed by the sputtering method (the electron beam evaporation method or other film forming methods may be used). By doing this, a Cr/Cu/Cr multi-layer 21 having an oxide film at the interface with the glass plate 4 is formed (FIG. 21*a*). It is desirable to set the film thickness of the chromium oxide film, which is the uppermost film, so that the reflectance is made smaller as viewed from the front side of the substrate. This multi-layer 21 is patterned by the photo-etching method which is the same method as that used at Step (1) of Embodiment 1 and bus electrodes 62 and 192 are formed on the surface of the glass plate 4 (FIG. 21*b*).

Figure 21C:
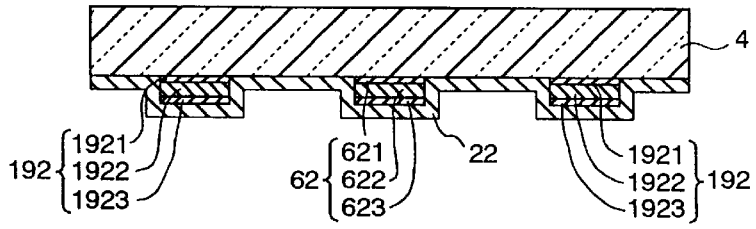
Figure 21D:
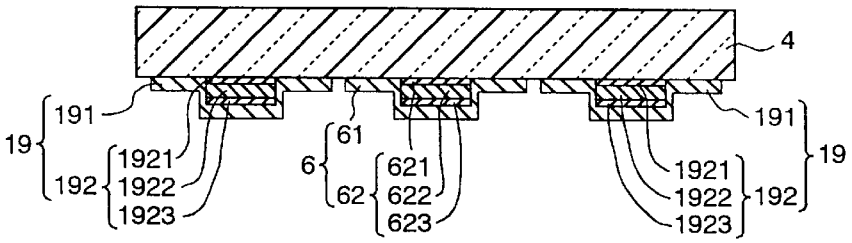

Next, an ITO film (tin oxide ($SnO_2$) film or other transparent conductive films may be used) 22 is formed on the surface of the glass plate 4 so as to cover the bus electrodes 62 and 192 by the sputtering method (the electron beam evaporation method or other film forming methods may be used) (FIG. 21*c*). This ITO film 22 is patterned by the photo-etching method which is the same method as that used at Step (1) of Embodiment 1 and display electrodes 61 and 91 are formed on the surface of the glass plate 4 so as to cover the bus electrodes 62 and 192 (FIG. 21*d*).

After the main discharge electrode is formed on the surface of the glass plate 4 by the aforementioned process, the dielectric layer 8 and the protective layer 9 are formed on the surface of the glass plate 4 so as to cover this electrode in the same way as with Embodiment 1 and the front substrate 1 of this embodiment is prepared.

According to this embodiment, the bus electrodes 62 and 192 are formed before the display electrodes 61 and 191 are formed, so that a high melting point metal oxide film can be formed easily on the top surface of the bus electrodes 62 and 192 (the bottom on the front side of the substrate).

Figure 26:
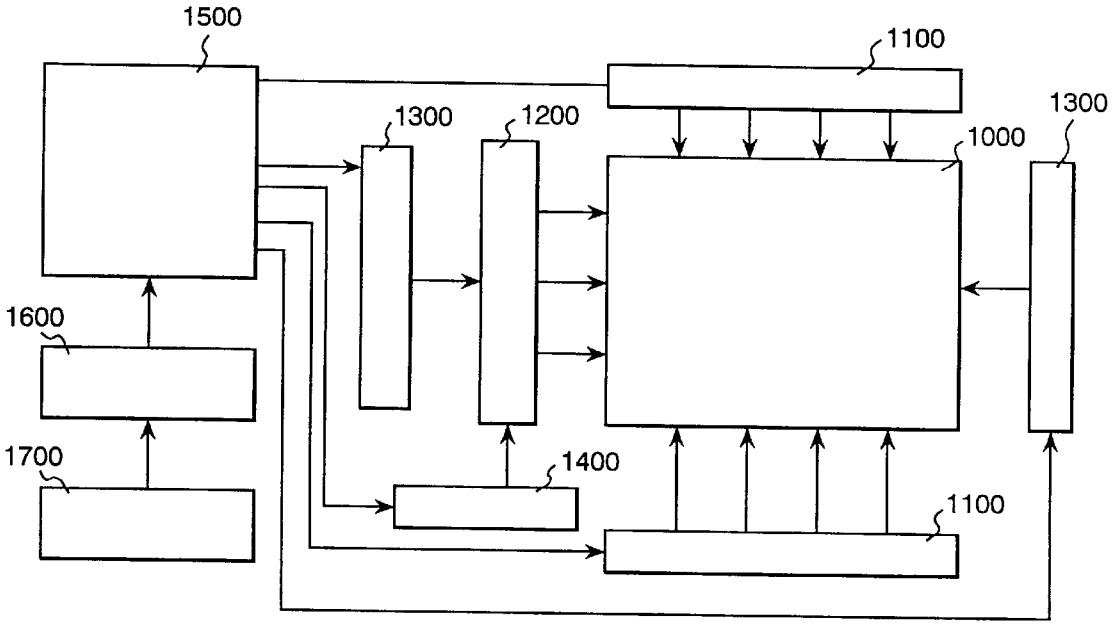
FIG. 26 is a block diagram showing the monitor or display unit of the present invention.

FIG. 26 shows a block diagram of a display unit using a gas discharge display panel of the type to which the present invention is applied. In the drawing, numeral 1100 indicates an address driver, 1200 a scan driver, 1300 a pulse generator, 1400 a level shifter, 1500 a control unit, 1600 an auto power control circuit, and 1700 a DC-DC converter. According to this display unit, a display cell is selected by the address driver 1100 and the scan driver 1200 and a main discharge for displaying is generated by a voltage generated by the pulse generator 1300. These processes are controlled by the control circuit. A control signal from the control circuit 1500 to the scan driver 1200 is—transferred via the level shifter 1400. The auto power control circuit detects a high voltage supply current and when the current is more than the specified value, the circuit sends a signal for decreasing the number of holding discharge pulses to the control circuit 1500. The DC-DC converter 1700 generates an internal voltage for the driving circuit from a voltage supplied from an outer circuit.

The display unit uses a gas discharge display panel 1000 of the present invention which can increase the contrast of the display image quality, so that a clear image having a high contrast can be obtained.

The gas discharge display panel of the present invention can cover a portion around a display cell which cannot be controlled in display with a pattern of an opaque material such as an electrode, so that the dignity of the black display status can be improved. When the bus electrodes and the pattern of an opaque material are arranged so as to overlay on the barrier ribs as viewed from the front substrate side, the aperture ratio of the display screen can be increased and light emitted from the phosphor which is effective in the display is efficiently radiated outside via the front substrate, so that the brightness can be made higher. As mentioned above, according to the present invention, a gas discharge display panel having a high contrast can be provided.

As mentioned above, in a conventional gas discharge display panel, the bus electrodes comprise only bandlike members. However, the bus electrodes of the present invention additionally have branchlike members and the branchlike members are provided in the cell separation areas between the display cells arranged in the extending direction of the address electrodes. When the cells are separated by barrier ribs, the branchlike members exist on the barrier ribs. By doing this, each display cell is surrounded by opaque bus electrodes, so that color bleeding and mixture can be prevented and the resistance of the bus electrodes can be lowered. As a result, the aperture ratio can be increased, so that the brightness is increased and the brightness in the dark state can be lowered, and hence the contrast becomes high.

What is claimed is:

1. A gas discharge display panel comprising a front substrate having a main discharge electrode group for generating a main discharge; a rear substrate having an auxiliary discharge electrode group for selecting a display cell to emit light, which rear substrate is arranged at a fixed interval with and is disposed opposite to said front substrate; barrier ribs for dividing the interval between said front substrate and said rear substrate into display cells; and a fluorescent layer formed in said display cells on an inner wall of a space in which said main discharge takes place; wherein said main discharge electrode group has a plurality of main discharge electrodes which extend in the same direction with respect to each other, and said main discharge electrodes include display electrodes made of a transparent material which are bandlike electrodes that extend in parallel with a main surface of said front substrate and a bus electrode provided for each of said display electrodes and in which one of the front and back surfaces thereof is in contact with said display electrode, and wherein said bus electrodes are made of an opaque conductive material and are arranged so as to make said display cells individually visible as viewed from a front surface side outside of said front substrate , wherein adjacent lines of display cells extend along the direction of the display electrodes, said bus electrodes each have a bandlike member extending in the extending direction of the display electrodes and a plurality of branchlike members extending from the bandlike member.

2. A gas discharge display panel according to claim 1, wherein, as viewed from said front substrate side of said gas discharge display panel, said bandlike member is provided so as to separate the lines of display cells extending along the direction of said display electrodes from each other and said branchlike members are provided so as to separate adjacent display cells in said lines of display cells extending in the direction of said display electrodes from each other.

3. A gas discharge display panel according to claim 1, wherein said barrier ribs have a first member for making each display cell belonging to a line of display cells extending along the direction of said display electrodes individually visible and said branchlike members of said bus electrodes are arranged so that at least one part thereof is overlaid on the bottom of said first member of said barrier ribs on said front substrate side as viewed from said front substrate side of said gas discharge display panel.

4. A gas discharge display panel according to claim 1, wherein said barrier ribs have a first member for making said display cells extending along the direction of said display electrodes and the adjacent lines of display cells individually visible, and said bandlike members of said bus electrodes are arranged so that at least one part thereof is overlaid on the bottom of said first member of said barrier ribs on said front substrate side as viewed from said front substrate side of said gas discharge display panel.

5. A gas discharge display panel according to claim 1, wherein said barrier ribs have a first member for making said display cells extending along the direction of said display electrodes and the adjacent lines of display cells individually visible, and said front substrate further has a plurality of screening members made of an opaque material which are disposed in parallel with said main surface and extend in the extending direction of said display electrodes, and said screening members are arranged so that at least one part thereof is overlaid on the bottom of said first member of said barrier ribs on said front substrate side as viewed from said front substrate side of said gas discharge display panel.

6. A gas discharge display panel according to claim 5, wherein said screening members are made of the same material as that of said bus electrodes.

7. A gas discharge display panel according to claim 1, wherein said gas discharge display panel further has a discharge space separating bulkhead wall for separating the space in each discharge cell into a main discharge space on said front substrate side and an auxiliary discharge space on a rear substrate side thereof and said discharge space separating bulkhead wall has a through path for effecting communication between said main discharge space and said auxiliary discharge space.

8. A gas discharge display panel according to claim 7, wherein said bus electrodes overlay an opening portion of said through path on said front substrate side as viewed from said front substrate side of said gas discharge display panel.

9. A gas discharge display panel according to claim 1, wherein two main discharge electrodes are provided for each line of said lines of display cells extending along the direction of said display electrodes, and said branchlike members of said bus electrode are provided on one side of said bandlike members of said bus electrodes, and said bus electrodes of said two main discharge electrodes corresponding to one display cell line are arranged opposite to each other with the sides thereof on which said branchlike members are provided facing inward toward each other.

10. A gas discharge display panel according to claim 1, wherein three main discharge electrodes are provided for each of two adjacent lines of display cells extending along the direction of said display electrodes and a central main discharge electrode among said three main discharge electrodes is provided so as to extend over said two adjacent lines of display cells.

11. A gas discharge display panel according to claim 10, wherein said barrier ribs have a first member for making said display cells of said lines of display cells extending along the direction of said display electrodes and the adjacent lines of display cells individually visible and bandlike members of said bus electrodes of said main discharge electrodes extend over two adjacent lines of display cells and are arranged so that at least one part thereof is overlaid on the bottom of said first member of said barrier ribs on said front substrate side as viewed from said front substrate side of said gas discharge display panel.

12. A gas discharge display panel according to claim 1, wherein said main discharge electrodes are provided for each line of said lines of display cells extending along the direction of said display electrodes and each main discharge electrode is provided so as to extend over two adjacent lines of display cells.

13. A gas discharge display panel according to claim 10, wherein the bus electrode of the central main discharge electrode among said three main discharge electrodes has branchlike members on both sides thereof, and the bus electrodes of the other main discharge electrodes have branchlike members on one side thereof, and said bus electrodes of said other main discharge electrodes are arranged so that the sides thereof on which said branchlike members are provided face said central main discharge electrode.

14. A gas discharge display panel according to claim 13, wherein said branchlike members of said bus electrodes are provided on both sides of said bandlike members of said bus electrodes.

15. A gas discharge display panel according to claim 1, wherein three lines of main discharge electrodes are provided for each line of display cells and the two electrodes on respective sides among said three main discharge electrodes are arranged as common electrodes to the main discharge electrodes of the adjacent lines of display cells.

16. A gas discharge display panel according to claim 15, wherein said gas discharge display panel further has a discharge space separating bulkhead wall for separating the space in each discharge cell of said lines of discharge cells into a main discharge space on said front substrate side and an auxiliary discharge space on a rear substrate side thereof, and said discharge space separating bulkhead wall has a through path for effecting communication between said main discharge space and said auxiliary discharge space.

17. A gas discharge display panel according to claim 16, wherein said gas discharge display panel further has a discharge space separating bulkhead wall for separating the space in each discharge cell into a main discharge space on said front substrate side and an auxiliary discharge space on said rear substrate side thereof, and said discharge space separating bulkhead wall has a through path for effecting communication between said main discharge space and said auxiliary discharge space, and said barrier ribs have a first member for making said display cells extending along the direction of said display electrodes and adjacent lines of display cells individually visible, and said bandlike members of said bus electrodes of said main discharge electrodes on respective sides among said three main discharge electrodes are arranged so that at least one part thereof is overlaid on the bottom of said first member of said barrier ribs on said front substrate side as viewed from said front substrate side of said gas discharge display panel, and said bandlike members of said bus electrodes of said central main discharge electrode among said three main discharge electrodes overlays the opening portion of said through path on said front substrate side as viewed from said front substrate side of said gas discharge display panel.

18. A gas discharge display panel according to claim 1, wherein said bus electrodes comprise a multi-layer film obtained by depositing a layer of a first high melting point metal, a layer of copper or aluminum, and a layer of a second high melting point metal in this order and said first high melting point metal and said second high melting point metal are one kind of metal among chromium, titanium, nickel, tungsten, and molybdenum or an alloy of said metals respectively.

19. A gas discharge display panel according to claim 18, wherein the surface of said bus electrodes facing the outside of said front substrate among the front and back thereof has an oxide film of said first or second high melting point metal.

20. A gas discharge display panel according to claim 1, wherein said bus electrodes are formed on the roughened surface of a transparent insulating material.

21. A gas discharge display panel according to claim 1, wherein in said front substrate, at least a base made of a transparent material, said bus electrodes, said display electrodes, and a dielectric layer are arranged in this order.

22. A display unit comprising a display panel, an address driver, a scan driver, an X-sustain pulse generator, and a Y-sustain pulse generator, wherein said display panel is a gas discharge display panel as defined in claim 1.

23. A method of manufacturing a gas discharge display panel comprising the steps of: forming a front substrate having a main discharge electrode group, forming a rear substrate having an auxiliary discharge electrode group for selecting a display cell to emit light, forming barrier ribs for dividing a gap between said front substrate and said rear substrate into display cells, a step of forming a fluorescent layer on an inner wall of a member in a space in which said main discharge takes place, and assembling said front substrate and said rear substrate, wherein said step of forming said front substrate includes a step of depositing a base made of a transparent material, bus electrodes having bandlike and branchlike portions, display electrodes, and a dielectric layer in this order.

24. A gas discharge display panel comprising a front substrate having a main discharge electrode group, a rear substrate having an auxiliary discharge electrode group for selecting a display cell to emit light, which rear substrate is arranged at a fixed interval with and disposed opposite to said front substrate, and a fluorescent layer formed on the inner wall of a space in which said main discharge takes place, wherein said main discharge electrodes include bus electrodes made of an opaque material and said bus electrodes constitute a frame surrounding the periphery of each display cell at least partially as viewed from said front substrate side of said gas discharge display panel.

25. A gas discharge display panel comprising a front substrate having a main discharge electrode group for generating a main discharge; a rear substrate having an auxiliary discharge electrode group for selecting a display cell to emit light, which rear substrate is arranged at a fixed interval with and is disposed opposite to said front substrate; barrier ribs for dividing the interval between said front substrate and said rear substrate into display cells; and a fluorescent layer formed in said display cells on an inner wall of a space in which said main discharge takes place; wherein said main discharge electrode group has a plurality of main discharge electrodes which extend in the same direction with respect to each other, and said main discharge electrodes include display electrodes made of a transparent material which are bandlike electrodes that extend in parallel with a main surface of said front substrate and a bus electrode provided for each of said display electrodes and in which one of the front and back surfaces thereof is in contact with said display electrode, wherein said bus electrodes are made of an opaque conductive material and are arranged so as to make said display cells individually visible as viewed from a front surface side outside of said front substrate, and wherein adjacent lines of display cells extend along the direction of said display electrodes, said bus electrodes each have a bandlike member extending in the extending direction of said display electrodes and a plurality of branchlike members extending from said bandlike member.

26. A display unit comprising a display panel, an address driver, a scan driver, an X-sustain pulse generator, and a Y-sustain pulse generator, wherein said display panel is a gas discharge display panel as defined in claim 25.

* * * * *